US009694583B2

(12) United States Patent
Ozaki

(10) Patent No.: US 9,694,583 B2
(45) Date of Patent: Jul. 4, 2017

(54) LIQUID EJECTION APPARATUS AND MOISTURIZING APPARATUS FOR LIQUID EJECTION HEAD

(71) Applicant: FUJIFILM Corporation, Tokyo (JP)

(72) Inventor: Yuichi Ozaki, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/179,071

(22) Filed: Jun. 10, 2016

(65) Prior Publication Data

US 2016/0361925 A1 Dec. 15, 2016

(30) Foreign Application Priority Data

Jun. 15, 2015 (JP) ..... 2015-120389

(51) Int. Cl.
*B41J 2/165* (2006.01)

(52) U.S. Cl.
CPC ..... *B41J 2/165* (2013.01); *B41J 2/16552* (2013.01)

(58) Field of Classification Search
None
See application file for complete search history.

(56) References Cited

U.S. PATENT DOCUMENTS 7,824,007 B2 * 11/2010 Chikamoto ..... B41J 2/16585 347/32
2006/0176333 A1 * 8/2006 Momose ..... B41J 2/16532 347/30
2007/0195122 A1 * 8/2007 Hiruma ..... B41J 2/16552 347/29
2011/0234693 A1 9/2011 Yamaguchi et al.

FOREIGN PATENT DOCUMENTS

| | | | |
|---|---|---|---|
| EP | 2574470 | A1 | 4/2013 |
| JP | 2010-125620 | A | 6/2010 |
| JP | 2011-206975 | A | 10/2011 |
| JP | 2014-8639 | A | 1/2014 |
| JP | 2014-19106 | A | 2/2014 |

OTHER PUBLICATIONS

Extended European Search Report dated Oct. 14, 2016, for European Application No. 16173278.9.

* cited by examiner

*Primary Examiner* — Alejandro Valencia
(74) *Attorney, Agent, or Firm* — Birch, Stewart, Kolasch & Birch, LLP

(57) ABSTRACT

The moisturizing apparatus includes: a liquid retainer arranged at a position facing a nozzle surface of a liquid ejection head, the nozzle surface being inclined relative to a horizontal plane, the liquid retainer being divided, along a direction of an inclination, into an uppermost liquid chamber, a lowermost liquid chamber and a middle liquid chamber arranged between the uppermost and lowermost liquid chambers, to store a moisturizer; a supply device which supplies the moisturizer to a liquid supply port provided in the middle liquid chamber, the supply device passing the moisturizer from the middle liquid chamber into the lowermost liquid chamber; and a discharge device which discharges the moisturizer from a waste liquid port provided in the middle liquid chamber, wherein the uppermost liquid chamber and a gas space in the lowermost liquid chamber are linked through.

11 Claims, 21 Drawing Sheets

FIG.23

| | CAPS 70、71、72、74 | CAP 76 | CAP 77 | CAP 78 | CAP 79 |
|---|---|---|---|---|---|
| MOISTURIZATION | +++ | +++ | +++ | +++ | + |
| NUMBER OF LIQUID SUPPLY SYSTEMS | +++ | +++ | +++ | + | +++ |
| NUMBER OF WASTE LIQUID SYSTEMS | +++ | +++ | + | +++ | +++ |
| TIME TAKEN FOR REPLACING LIQUID | +++ | + | + | +++ | +++ |
| AMOUNT OF LIQUID NEEDED FOR REPLACING LIQUID | +++ | + | + | ++ | +++ |
| CONTAMINATION OF LIQUID IN MIDDLE LIQUID CHAMBERS AFTER REPLACING LIQUID | +++ | ++ | +++ | +++ | +++ |

LIQUID EJECTION APPARATUS AND MOISTURIZING APPARATUS FOR LIQUID EJECTION HEAD

CROSS-REFERENCE TO RELATED APPLICATIONS

The present application claims priority under 35 U.S.C. §119 to Japanese Patent Application No. 2015-120389, filed on Jun. 15, 2015. The above application is hereby expressly incorporated by reference, in its entirety, into the present application.

BACKGROUND OF THE INVENTION

Field of the Invention

The present invention relates to liquid ejection apparatuses and moisturizing apparatuses for a liquid ejection head. The present invention more particularly relates to a liquid ejection apparatus and a moisturizing apparatus for a liquid ejection head, which moisturize the periphery of a nozzle unit in order to prevent clogging of nozzles in the liquid ejection head.

Description of the Related Art

The liquid ejection head represented by an inkjet head may cause clogging as liquid in nozzles is thickened while the head is not in operation or is in a standby state. In order to prevent such clogging, there is known a technique which seals the periphery of the nozzle unit with a moisturizing cap having a moisturizer container and moisturizes the periphery of the nozzle unit with a moisturizer contained in the moisturizer container.

An image recording apparatus is known which has a liquid ejection head arranged to be inclined relative to the horizontal along a peripheral surface of a conveying drum which conveys a record medium retained on the peripheral face. When such a liquid ejection head is moisturized with the moisturizing cap, the moisturizer contained in the moisturizer container has a horizontal liquid surface. This increases a distance between an upper part of the liquid ejection head which is arranged to be inclined and the liquid surface, and causes a problem that a sufficient moisturizing property cannot be attained.

As a method for attaining the moisturizing property, it may be considered to enhance sealability between the liquid ejection head and the moisturizing cap. However, when the liquid ejection head has an uneven shape, or when the liquid ejection head is constituted of a plurality of head modules to enhance replaceability and mass productivity, it is difficult to enhance the sealability.

To solve such problems, Japanese Patent Application Laid-Open No. 2014-019106 discloses a technique of increasing humidity in the periphery of the nozzle unit. In this technique, a moisturizer container is divided into a plurality of storages in an inclined direction, and the moisturizer is stored in the plurality of storages so that the moisturizer have liquid surfaces different in height in the inclined direction, and a distance between the liquid surfaces of the moisturizer and the inclined nozzle surfaces is reduced to increase the humidity.

SUMMARY OF THE INVENTION

However, when the liquid retainer is divided into a plurality of storages as in the technique of Japanese Patent Application Laid-Open No. 2014-019106, a supply device which supplies the moisturizer to each of the storages and a discharge device which discharges the moisturizer are required, and this causes a problem that the moisturizing cap has a complicated configuration.

The present invention has been made in view of such circumstances, and it is an object of the present invention to provide a liquid ejection apparatus and a moisturizing apparatus for a liquid ejection head, which enhance a moisturizing property with a simplified configuration.

To accomplish the above object, one aspect of a liquid ejection apparatus includes: a liquid ejection head having a nozzle surface arranged to be inclined relative to a horizontal plane, the nozzle surface having a nozzle region with a nozzle which ejects liquid formed thereon and a non-nozzle region having the nozzle not formed thereon; a liquid retainer arranged at a position facing the nozzle surface of the liquid ejection head, the liquid retainer being divided, along a direction of an inclination of the nozzle surface, into an uppermost liquid chamber arranged on an uppermost stage in a perpendicular direction so as to face the non-nozzle region, a lowermost liquid chamber arranged on a lowermost stage in the perpendicular direction so as to face the non-nozzle region, and a middle liquid chamber arranged between the uppermost liquid chamber and the lowermost liquid chamber so as to face the nozzle region, to store a moisturizer; a supply device which supplies the moisturizer to a liquid supply port provided in the middle liquid chamber, the supply device passing the moisturizer, which overflows from the middle liquid chamber, into the lowermost liquid chamber; and a discharge device which discharges the moisturizer from a waste liquid port provided in the middle liquid chamber, wherein while the moisturizer is stored in the liquid retainer, the uppermost liquid chamber and a gas space in the lowermost liquid chamber are linked through at least one region out of regions on a lateral surface side and a back surface side which are different from an open surface side of the middle liquid chamber.

According to the present aspect, the moisturizer is stored in the middle liquid chamber and the lowermost liquid chamber just by supplying the moisturizer to the liquid supply port provided in the middle liquid chamber. Therefore, the liquid surfaces of this moisturizer can moisturize the nozzle region which faces the middle liquid chamber and the non-nozzle region which faces the lowermost liquid chamber. Moreover, while the moisturizer is stored, the uppermost liquid chamber and the gas space in the lowermost liquid chamber are linked through at least one region out of the regions on the lateral surface side and the back surface side which are different from the open surface side of the middle liquid chamber. This makes it possible to moisturize the non-nozzle region which faces the uppermost liquid chamber. Furthermore, the discharge device can appropriately discharge the moisturizer from the middle liquid chamber which faces the nozzle region.

It is preferable that the liquid retainer has a plurality of middle liquid chambers divided along the direction of the inclination, the liquid supply port is provided in an uppermost middle liquid chamber, among the plurality of middle liquid chambers, which is positioned on an uppermost stage in the perpendicular direction, and the plurality of middle liquid chambers other than the uppermost middle liquid chamber are sequentially supplied with the moisturizer overflowing from the uppermost middle liquid chamber and flowing into the middle liquid chambers on a lower side in the perpendicular direction. Since the moisturizer has liquid surfaces formed with a height difference in the direction of inclination in the middle liquid chambers, the nozzle region can appropriately be moisturized.

It is preferable to include a discharge device which discharges the moisturizer from each of waste liquid ports provided in the plurality of middle liquid chambers. As a consequence, the moisturizer can appropriately be discharged from the plurality of middle liquid chambers.

It is preferable that the liquid retainer includes: a first box-shaped member including a first bottom plate and a first side plate raised on a periphery of the first bottom plate; and a second box-shaped member including a second bottom plate and a second side plate raised on a periphery of the second bottom plate, the second box-shaped member being arranged in an opening of the first box-shaped member, the second box-shaped member constitutes the middle liquid chambers, with the first bottom plate and the second bottom plate being arranged at an interval, and while the moisturizer is stored, the uppermost liquid chamber on an upper side in a perpendicular direction of the second box-shaped member and the gas space in the lowermost liquid chamber on a lower side in the perpendicular direction are linked through a region between the first bottom plate and the second bottom plate. As a consequence, the uppermost liquid chamber and the lowermost liquid chamber can be linked through a region on the back surface side of the middle liquid chamber.

While the moisturizer is stored, the uppermost liquid chamber and the gas space in the lowermost liquid chamber are preferably linked through a region between the first side plate and the second side plate, the region being different from a region on a side of the uppermost liquid chamber and a region on a side of the lowermost liquid chamber. As a consequence, the uppermost liquid chamber and the lowermost liquid chamber can be linked through a region on the lateral surface side of the middle liquid chamber.

It is preferable that the liquid retainer includes: a first box-shaped member including a first bottom plate and a first side plate raised on a periphery of the first bottom plate; and a surrounded region surrounded with a second side plate raised inside the first side plate, the surrounded region constitutes the middle liquid chambers, and while the moisturizer is stored, the uppermost liquid chamber on an upper side in a perpendicular direction of the surrounded region and the gas space in the lowermost liquid chamber on a lower side in the perpendicular direction are linked through a region between the first side plate and the second side plate, the region being different from a region on a side of the uppermost liquid chamber and a region on a side of the lowermost liquid chamber. As a consequence, the uppermost liquid chamber and the lowermost liquid chamber can be linked through a region on the lateral surface side of the middle liquid chamber.

It is preferable that the liquid retainer includes: a first partitioning member which divides an inside of the liquid retainer into a plurality of liquid chambers along the direction of the inclination; an air supply port provided in the lowermost liquid chamber; an exhaust port provided in the uppermost liquid chamber; and an air supply pipe which links the air supply port and the exhaust port through at least one region out of the regions on the lateral surface side and the back surface side of the middle liquid chamber. As a consequence, the uppermost liquid chamber and the lowermost liquid chamber can be linked through at least one region out of the regions on the lateral surface side and the back surface side of the middle liquid chamber.

It is preferable to include a waste fluid retainer which receives an inflow of the moisturizer overflowing from the lowermost liquid chamber. As a consequence, the moisturizer in the lowermost liquid chamber can be discharged without a discharge device provided in the lowermost liquid chamber.

It is preferable to include a conveying drum which conveys a recording medium by retaining the recording medium on a peripheral surface, wherein the liquid ejection head has the nozzle surface being arranged to be inclined relative to the horizontal plane along the peripheral surface of the conveying drum. The present aspect is adequate for the liquid ejection head having the nozzle surface being arranged to be inclined relative to the horizontal plane along the peripheral surface of the conveying drum.

It is preferable that the liquid ejection head is a line head including a plurality of head modules arrayed in one direction. Since the present aspect includes a plurality of head modules, the present aspect is adequate for the liquid ejection head which has difficulty in sealing the periphery of the nozzle unit.

To accomplish the above object, one aspect of a moisturizing apparatus for a liquid ejection head includes: a liquid retainer arranged at a position facing a nozzle surface of a liquid ejection head arranged to be inclined relative to a horizontal plane, the nozzle surface having a nozzle region with a nozzle which ejects liquid formed thereon and a non-nozzle region having the nozzle not formed thereon, the liquid retainer being divided, along a direction of an inclination of the nozzle surface, into an uppermost liquid chamber arranged on an uppermost stage in a perpendicular direction so as to face the non-nozzle region, a lowermost liquid chamber arranged on a lowermost stage in the perpendicular direction so as to face the non-nozzle region, and a middle liquid chamber arranged between the uppermost liquid chamber and the lowermost liquid chamber so as to face the nozzle region to store a moisturizer; a supply device which supplies the moisturizer to a liquid supply port provided in the middle liquid chamber, the supply device passing the moisturizer, which overflows from the middle liquid chamber, into the lowermost liquid chamber; and a discharge device which discharges the moisturizer from a waste liquid port provided in the middle liquid chamber, wherein while the moisturizer is stored in the liquid retainer, the uppermost liquid chamber and a gas space in the lowermost liquid chamber are linked through at least one region out of regions on a lateral surface side and a back surface side which are different from an open surface side of the middle liquid chamber.

According to the present aspect, the moisturizer is stored in the middle liquid chamber and the lowermost liquid chamber just by supplying the moisturizer to the liquid supply port provided in the middle liquid chamber. Therefore, the liquid surfaces of the moisturizer can moisturize the nozzle region which faces the middle liquid chamber and the non-nozzle region which faces the lowermost liquid chamber. Moreover, while the moisturizer is stored, the uppermost liquid chamber and the gas space in the lowermost liquid chamber are linked through at least one region out of regions on the lateral surface side and the back surface side which are different from the open surface side of the middle liquid chamber. This makes it possible to moisturize the non-nozzle region which faces the uppermost liquid chamber. Furthermore, the discharge device can appropriately discharge the moisturizer from the middle liquid chamber which faces the nozzle region.

According to the present invention, the moisturizing property can be enhanced with a simplified configuration.

BRIEF DESCRIPTION OF THE DRAWINGS

FIG. 23 illustrates evaluation results of the caps according to the comparative examples and the caps according to the present embodiments in view of each point.

DETAILED DESCRIPTION OF THE EMBODIMENTS

Hereinafter, embodiments of the present invention are described in detail with reference to the accompanying drawings.

<Configuration of Inkjet Recording Apparatus>

Figure 1:
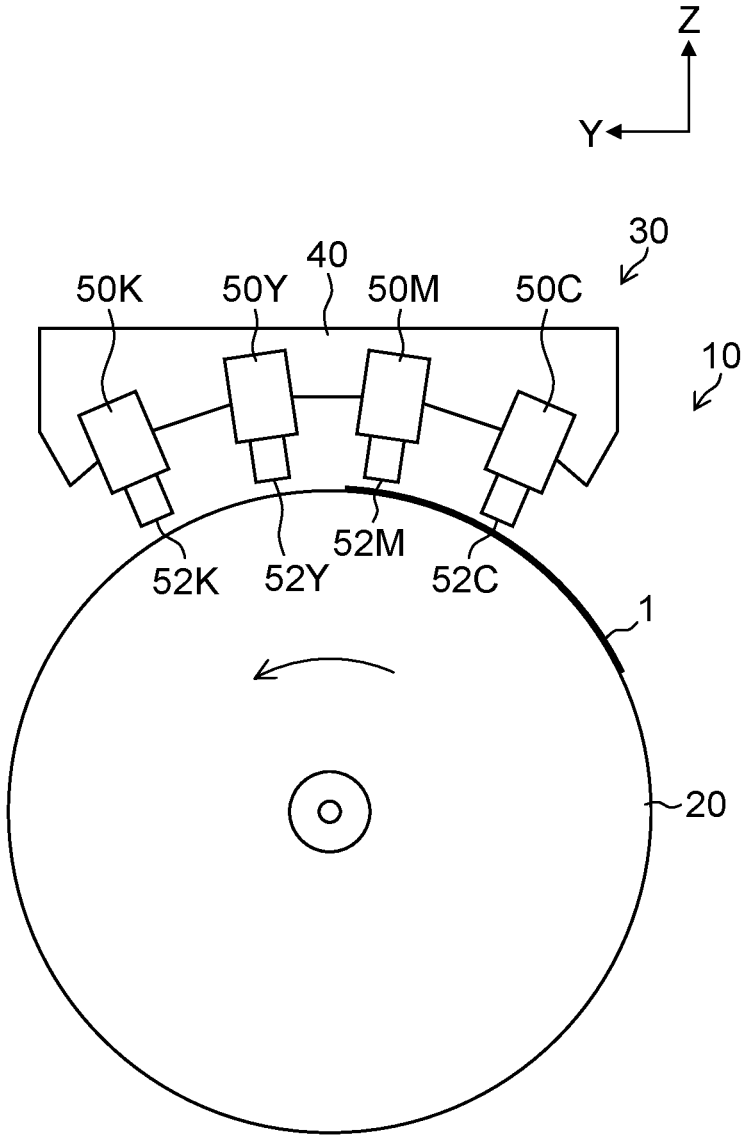
FIG. 1 is a side view illustrating the configuration of main components of an inkjet recording apparatus.
Figure 2:
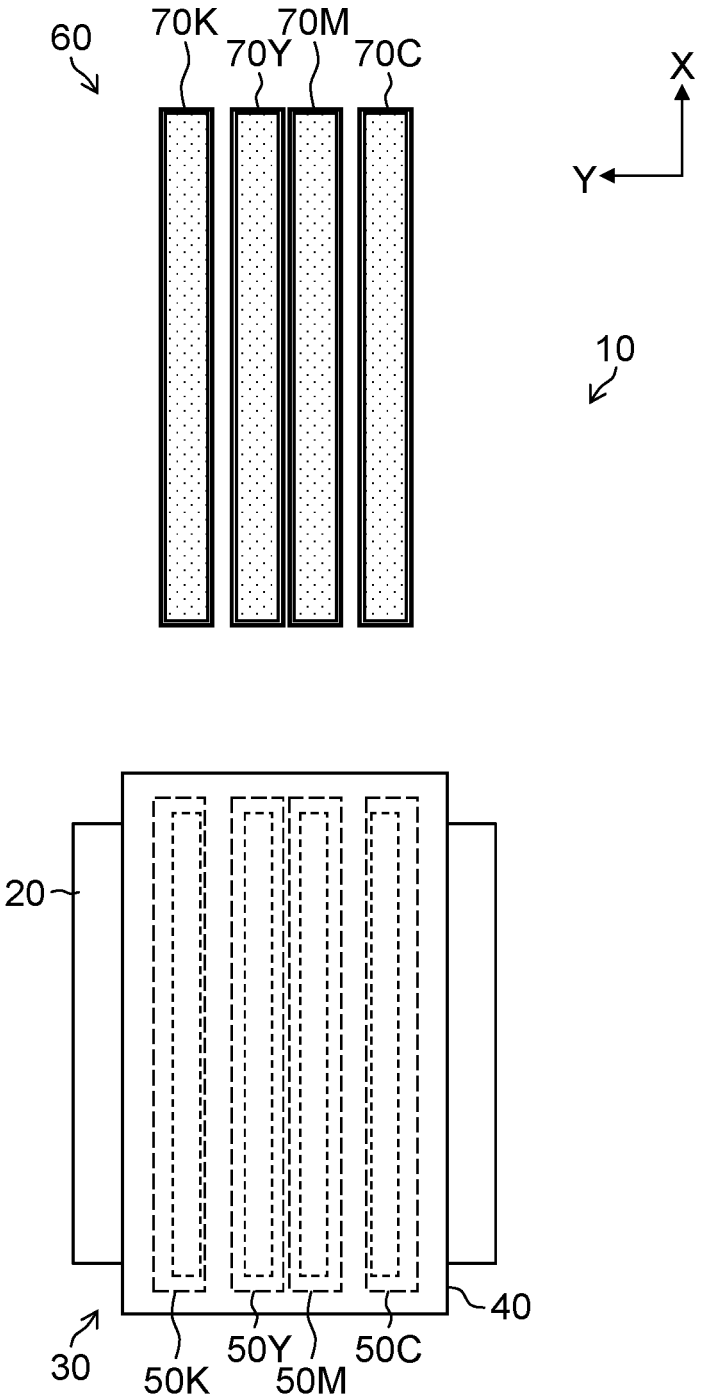
FIG. 2 is a top view of the inkjet recording apparatus.

As illustrated in FIGS. 1 and 2, an inkjet recording apparatus 10 (one example of the liquid ejection apparatus) is a single-pass line printer. The inkjet recording apparatus 10 mainly includes: a conveying drum 20 which conveys a paper sheet 1 as a recording medium; a head unit 30 which ejects droplets of water-based inks of respective colors, including cyan (C), magenta (M), yellow (Y), and black (K), toward the paper sheet I conveyed by the conveying drum 20; and a moisturizing unit 60 which moisturizes each of the inkjet heads mounted on the head unit 30.

The conveying drum 20 is driven to rotate by a motor (not illustrated). The conveying drum 20 has a gripper (not illustrated) provided on its peripheral surface. The paper sheet 1 is conveyed while a tip thereof being grasped by the gripper. The conveying drum 20 also has a large number of suction holes (not illustrated) formed on its peripheral surface. Air is sucked inward from these suction holes. The paper sheet 1 is conveyed while being sucked and held by these suction holes.

The head unit 30 includes inkjet heads 50C, 50M, 50Y, and 50K (as examples of the liquid ejection heads, which are hereinafter simply referred to as heads 50C, 50M, 50Y, and 50K) which eject ink droplets in cyan, magenta, yellow, and black. The head unit 30 also includes a head retainer 40 having each of the heads 50C, 50M, 50Y, and 50K attached thereto, and a moving mechanism (not illustrated) which moves the head retainer 40.

The heads 50C, 50M, 50Y, and 50K are line heads corresponding to a maximum paper width (a width in X direction) of the paper sheet 1 on which an image is to be formed.

The heads are formed into the shape of rectangular blocks with nozzle surfaces 52C, 52M, 52Y, and 52K being formed on the bottoms of the blocks.

The head retainer 40 includes a head attaching unit (not illustrated) for attaching each of the heads 50C, 50M, 50Y, and 50K. The heads 50C, 50M, 50Y, and 50K are each removably attached to the head attaching unit.

The heads 50C, 50M, 50Y, and 50K attached to the head retainer 40 are each arranged to be orthogonal to a conveyance direction (Y direction) of the paper sheet 1, and are also arranged in a specified order at a constant interval along the conveyance direction of the paper sheet 1.

Figure 3:
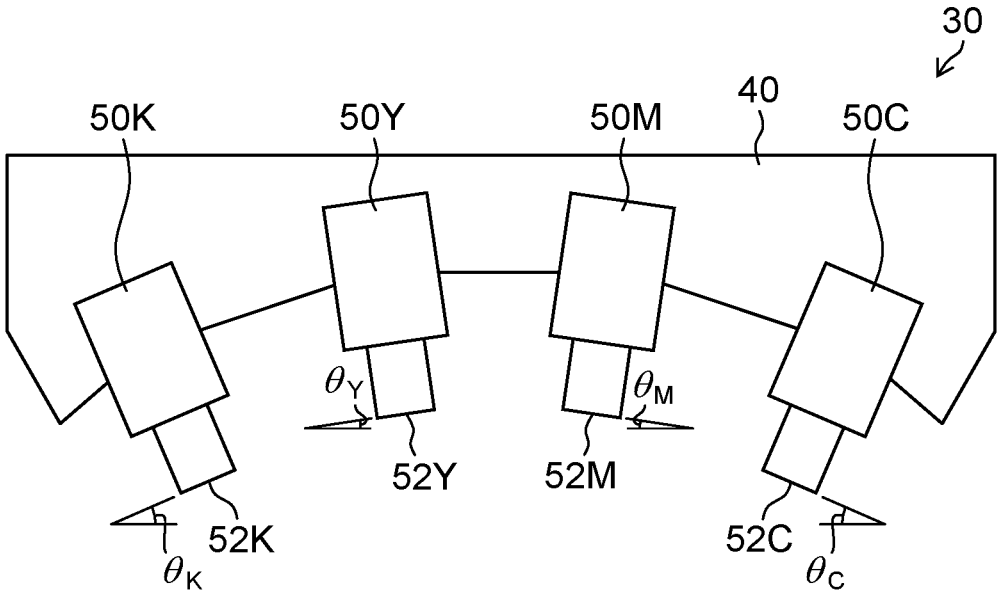
FIG. 3 is an enlarged view of a head unit.

The heads 50C, 50M,. 50Y, and 50K are each attached to the head retainer 40 so that respective nozzle surfaces 52C, 52M, 52Y, and 52K are parallel with corresponding tangential lines on the peripheral surface of the conveying drum 20 facing the nozzle surfaces. That is, the heads 50C, 50M, 50Y, and 50K are each arranged so that the nozzle surfaces 52C, 52M, 52Y, and 52K are inclined relative to a horizontal plane along the peripheral surface of the conveying drum 20. As illustrated in FIG. 3, angles formed between each of the nozzle surfaces 52C, 52M, 52Y, and 52K and the horizontal plane are defined as $\theta_C$, $\theta_M$, $\theta_Y$, and $\theta_K$, respectively.

The head attaching unit, which is liftably provided in the head retainer 40, is lifted by a lifting mechanism which is not illustrated. The heads 50C, 50M, 50Y, and 50K attached to the head attaching unit are lifted by the lifting mechanism at right angles with respect to the horizontal plane.

The moving mechanism which is not illustrated horizontally slides the head retainer 40 in X direction. The moving mechanism includes: a ceiling frame horizontally installed over the conveying drum 20 and the moisturizing unit 60; a guide rail constructed on the ceiling frame; a traveling body which slides on the guide rail; and a driving device (such as a feed screw mechanism) which moves the traveling body along the guide rail. The head retainer 40, which is attached to the traveling body, is slid horizontally.

The head retainer 40 is provided to be driven by the moving mechanism so that the head retainer 40 is movable between "image formation position" and "moisturizing position."

At the image formation position, the head retainer 40 is arranged above the conveying drum 20. This enables the head retainer 40 to deposit inks of respective colors on a recording surface of the paper sheet 1 conveyed with the conveying drum 20 and to thereby record an image thereon. At the moisturizing position, the head retainer 40 is arranged at a position where the moisturizing unit 60 is installed. As a consequence, the heads 50C, 50M, 50Y, and 50K are each moisturized to prevent inks inside the nozzles from being solidified.

<Configuration of Inkjet Head>

Since the heads 50C, 50M, 50Y, and 50K are similar to each other in configuration, a head representative of the respective heads is designated by reference numeral 50, and a nozzle surface thereof is designated by reference numeral 52.

Figure 4:
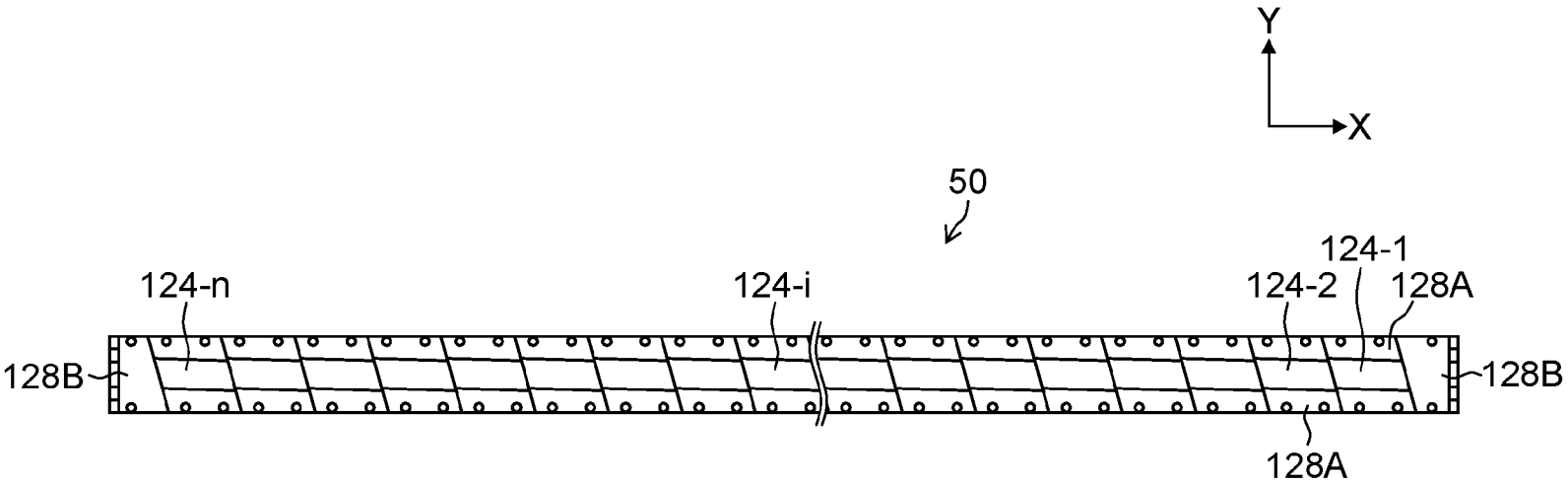
FIG. 4 is a plan view illustrating a configuration example of an inkjet head as viewed from a nozzle surface side.

As illustrated in FIG. 4, the head 50 is configured so that n head modules 124-i (i=1, 2, 3, . . . , n) are connected in a direction (X direction as an example of one direction) orthogonal to a conveyance direction (Y direction) of the paper sheet 1 by the conveying drum 20. Over a length of the head 50 corresponding to the overall width of the recording medium, a plurality of nozzles (not illustrated in FIG. 4) are provided.

Figure 5:
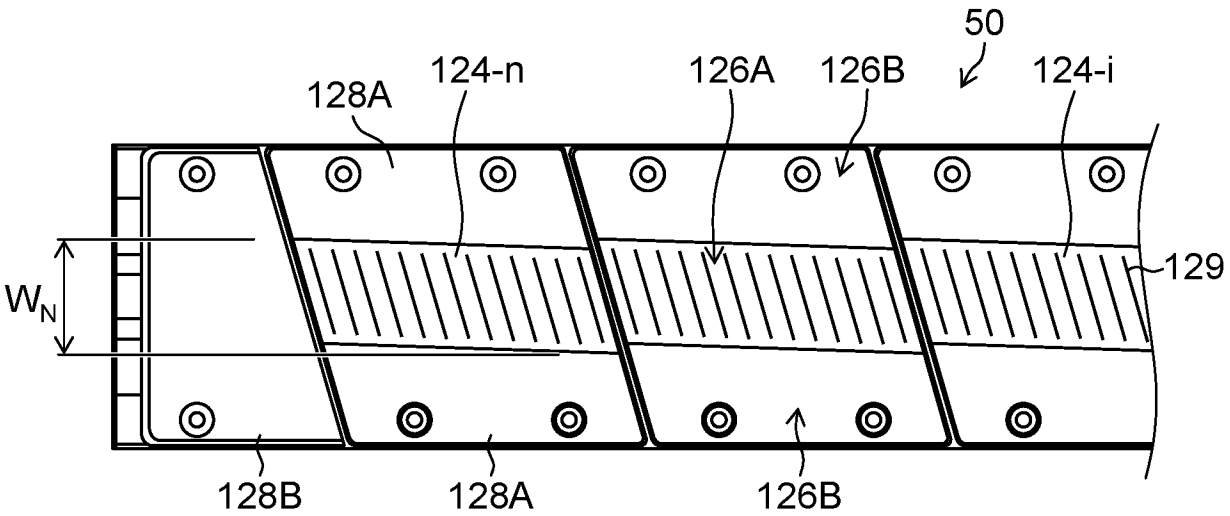
FIG. 5 is a partially expanded view of FIG. 4.

As illustrated in FIG. 5, each of the head modules 124-i is supported by a head module support member 128A from both sides of a short direction (Y direction) in the head 50. Both the end portions in a longitudinal direction (X direction) of the head 50 are supported by a head support member 128B. Each of the head modules 124-i has a configuration in which a plurality of nozzles (not illustrated in FIG. 5) are arrayed in a matrix form. Slant solid lines designated by reference numeral 129 in FIG. 5 represent a nozzle row made up of a plurality of nozzles placed side by side.

The number of the nozzles formed on the nozzle surface 52 of the head 50 and their array form are not particularly limited. The head 50 ejects inks from the nozzles by a piezo method or a thermal method.

The nozzle surface 52 includes a nozzle region 126A with the nozzles arranged thereon and a non-nozzle region 126B with the nozzles not arranged thereon. A width in Y direction of the nozzle region 126A is defined as $W_N$.

<Configuration of Moisturizing Unit>

Figure 6:
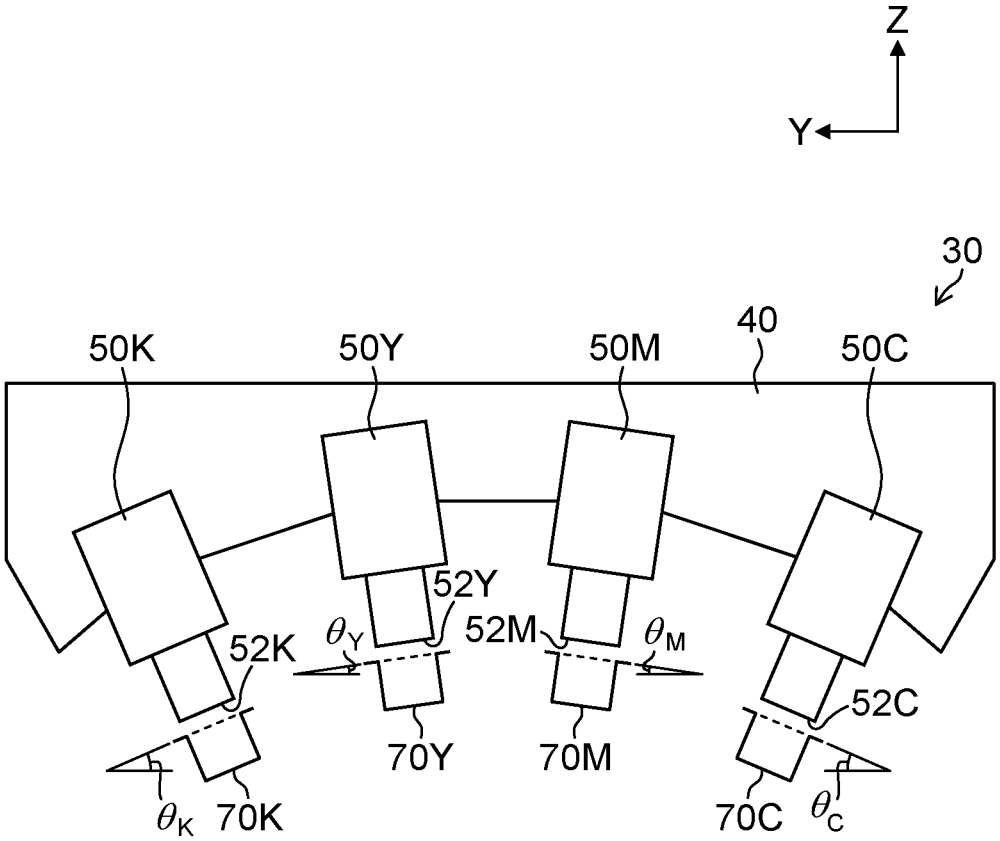
FIG. 6 is a schematic view of a moisturizing unit and the head unit moved to a moisturizing position.

As illustrated in FIG. 6, the moisturizing unit 60 (one example of the moisturizing apparatus) includes caps 70C, 70M, 70Y, and 70K which moisturize the nozzle surfaces 52C, 52M, 52Y, and 52K of the heads 50C, 50M, 50Y, and 50K, respectively. The caps 70C, 70M, 70Y, and 70K store a moisturizer 202 (see FIG. 9). The moisturizer 202 is a liquid containing a solvent identical to the solvent of the inks ejected from the nozzles in each of the heads 50C, 50M, 50Y, and 50K. For example, the liquid contains water as a main constituent.

The caps 70C, 70M, 70Y, and 70K are each provided to be horizontally inclined by angles $\theta_C$, $\theta_M$, $\theta_Y$, and $\theta_K$ with an axis parallel to X direction as an axis of rotation, respectively. That is, open surfaces of the respective caps 70C, 70M, 70Y, and 70K are arranged in parallel with the nozzle surfaces 52C, 52M, 52Y, and 52K of the respective heads 50C, 50M, 50Y, and 50K. The caps 70C, 70M, 70Y, and 70K each have a sealing member which is not illustrated, so that the nozzle surfaces 52C, 52M, 52Y, and 52K of the heads 50C, 50M, 50Y, and 50K can be sealed. The sealed nozzle surfaces 52C, 52M, 52Y, and 52K are moisturized by the moisturizer 202 stored inside the caps 70C, 70M, 70Y, and 70K.

<First Embodiment>

(Configuration of Liquid Retainer)

As described before, the caps 70C, 70M, 70Y, and 70K are arranged to be inclined relative to the horizontal plane in accordance with angles of inclination of the nozzle surfaces 52C, 52M, 52Y, and 52K which are inclined relative to the horizontal plane.

Since the caps 70C, 70M, 70Y, and 70K are similar to each other in configuration except for the angle of inclination, a cap representative of these caps is designated by reference numeral 70.

Figure 7:
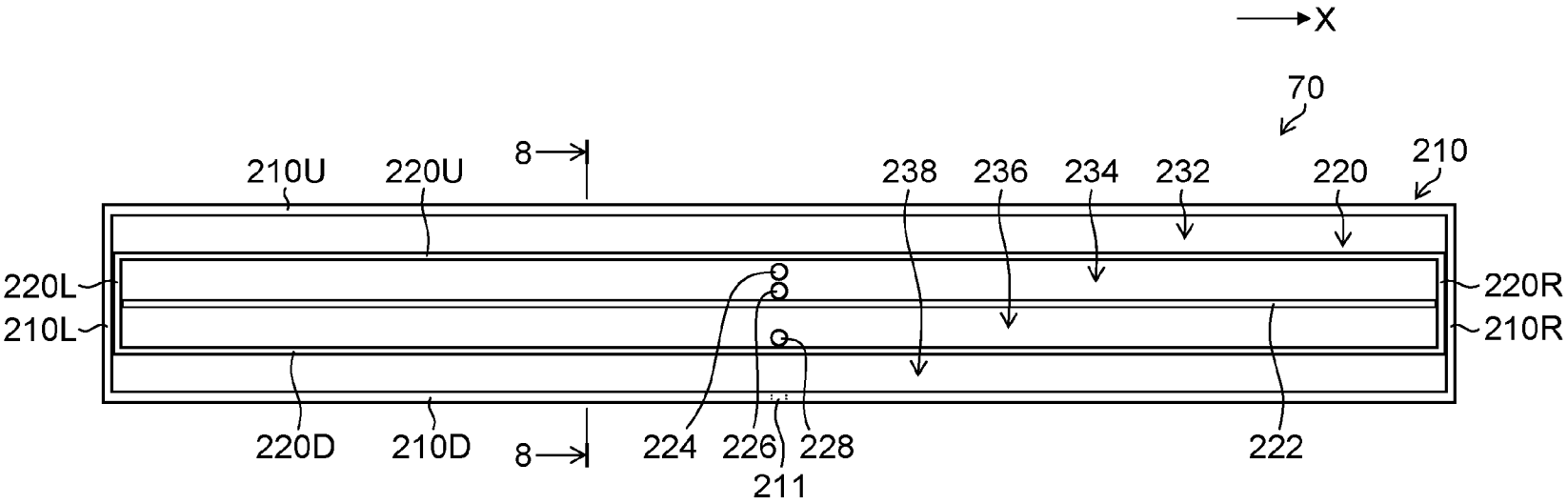
FIG. 7 illustrates a cap as viewed from an open surface side (as viewed from an arrow line A of FIG. 8)
Figure 8:
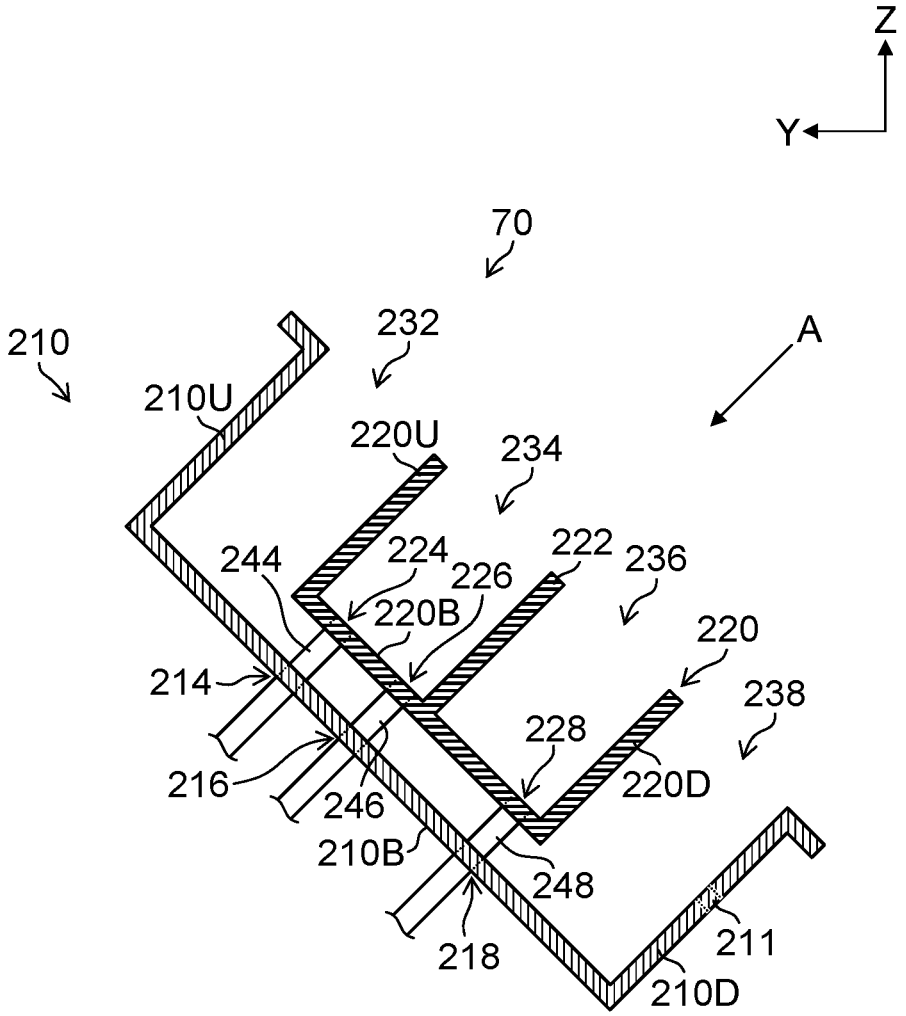
FIG. 8 is a cross sectional view illustrating the cap along an 8-8 line of FIG. 7.

As illustrated in FIGS. 7 and 8, the cap 70 includes a first liquid retainer 210 and a second liquid retainer 220, each of which is a hollow box-shaped member with one face being opened. The cap 70 has a dual configuration in which the second liquid retainer 220 is provided inside the first liquid retainer 210.

The first liquid retainer 210 (one example of the first box-shaped member) has a rectangular parallelepiped shape formed of: a rectangular bottom plate 210B; a pair of a right side plate 210R and a left side plate 210L which are provided at right angles with respect to the peripheries of the sides extending in X direction of the bottom plate 210B so as to face each other; and a pair of an upper plate 210U and a lower plate 210D which are provided at right angles with respect to the peripheries of the sides orthogonal to the sides extending in X direction of the bottom plate 210B so as to face each other. The right side plate 210R, the left side plate 210L, the upper plate 210U, and the lower plate 210D correspond to the first side plate.

Similarly, the second liquid retainer 220 (one example of the second box-shaped member) has a rectangular parallelepiped shape formed of: a rectangular bottom plate 220B; a pair of a right side plate 220R and a left side plate 220L which are provided at right angles with respect to the peripheries of the sides extending in X direction of the bottom plate 220B so as to face each other; and a pair of an upper plate 220U and a lower plate 220D which are provided on the peripheries of the sides orthogonal to the sides extending in X direction of the bottom plate 220B so as to face each other. The right side plate 220R, the left side plate 220L, the upper plate 220U, and the lower plate 220D correspond to the second side plate. Here, a distance between a pair of the upper plate 220U and the lower plate 220D is identical to the width $W_N$ in Y direction of the nozzle region 126A of the inkjet head 50.

The distance between a pair of the upper plate 220U and the lower plate 220D may be set larger than $W_N$.

Between the upper plate 220U and the lower plate 220D, a partition plate 222, which is in contact with the bottom plate 220B, the right side plate 220R and the left side plate 220L without any clearance, is raised in a direction parallel to the upper plate 220U and the lower plate 220D.

When the right side plate 220R and the left side plate 220L of the second liquid retainer 220 are each in contact with the right side plate 210R and the left side plate 210L of the first liquid retainer 210, the second liquid retainer 220 is supported by the first liquid retainer 210 in the state where the bottom plate 210B and the bottom plate 220B are arranged in parallel at a constant interval.

In the cap 70 configured in this way, there are formed: a first middle liquid chamber 234 partitioned with the bottom plate 220B, the right side plate 220R, the left side plate 220L, the upper plate 220U, and the partition plate 222; and a second middle liquid chamber 236 partitioned with the bottom plate 220B, the right side plate 220R, the left side plate 220L, the partition plate 222, and the lower plate 220D. More specifically, the second liquid retainer 220 is divided into a plurality of regions with the partition plate 222 in an inclined direction of the cap 70, with the first middle liquid chamber 234 being formed on the upper side in the inclined direction and the second middle liquid chamber 236 being formed on the lower side.

In the cap 70, there are further formed: an uppermost liquid chamber 232 partitioned with the bottom plate 210B, the right side plate 210R, the left side plate 210L, the upper plate 210U, and the upper plate 220U; and a lowermost liquid chamber 238 partitioned with the bottom plate 210B, the right side plate 210R, the left side plate 210L, the lower plate 220D, and the lower plate 210D. More specifically, the first middle liquid chamber 234 and the second middle liquid chamber 236 are arranged between the uppermost liquid chamber 232 and the lowermost liquid chamber 238.

The uppermost liquid chamber 232 and the lowermost liquid chamber 238 are linked through a region formed between the bottom plate 210B and the bottom plate 220B.

The first middle liquid chamber 234 has a liquid supply port 224 and a waste liquid port 226 provided in the bottom plate 220B. The liquid supply port 224 and the waste liquid port 226 are connected to a liquid supply pipe 244 and a waste liquid pipe 246, respectively. The liquid supply pipe 244 and the waste liquid pipe 246 fitly penetrate a through hole 214 and a through hole 216 which are provided in the bottom plate 210B, respectively.

The second middle liquid chamber 236 has a waste liquid port 228 provided in the bottom plate 220B. The waste liquid port 228 is connected to a waste liquid pipe 248. The waste liquid pipe 248 fitly penetrates the through hole 218 provided in the bottom plate 210B.

The liquid supply port 224, the waste liquid port 226, and the waste liquid port 228 may be provided in the right side plate 220R or the left side plate 220L.

The lowermost liquid chamber 238 has an overflow port 211 provided in the lower plate 210D.

Figure 9:
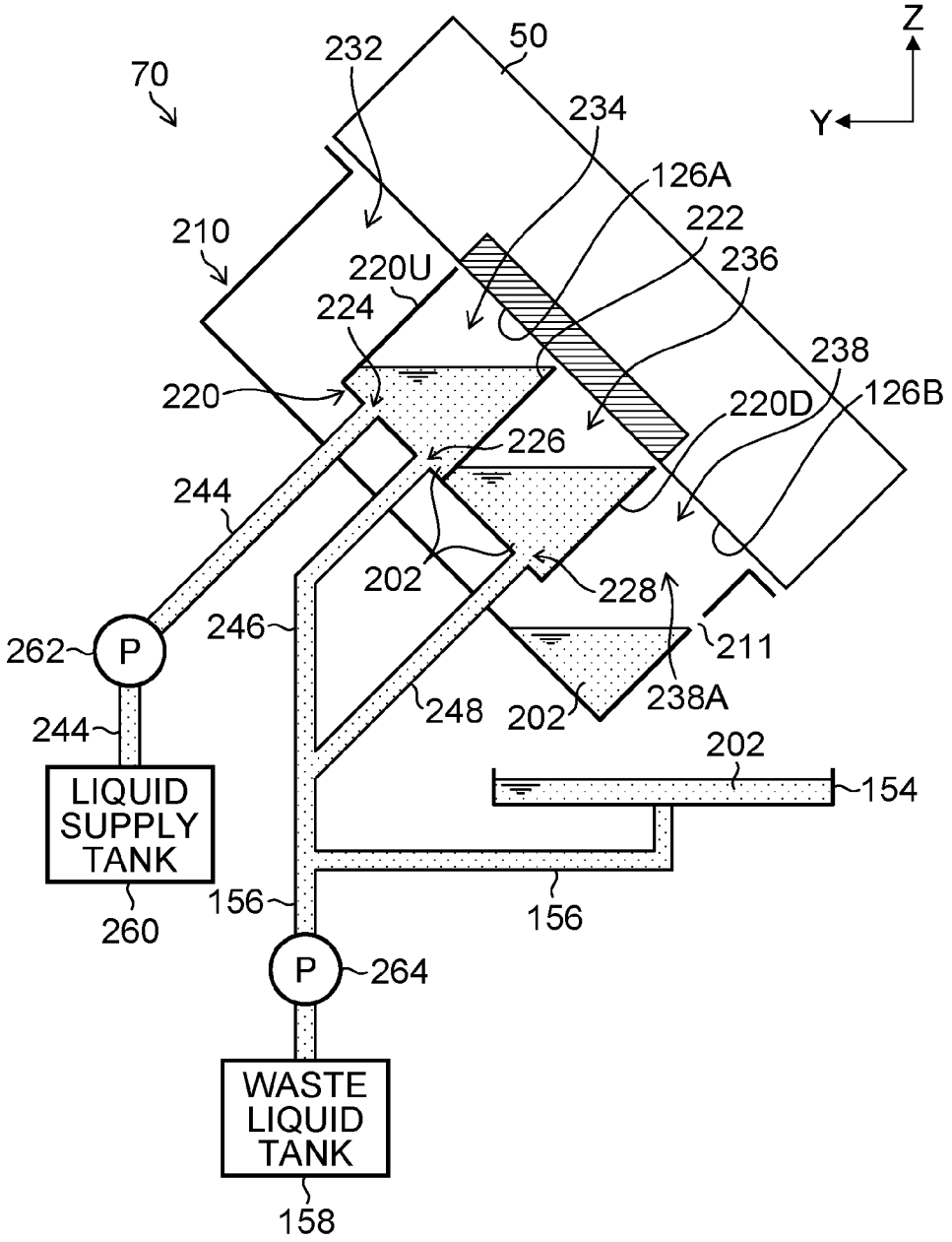
FIG. 9 is a sectional side view illustrating a head in a moisturized state at such time as during printing standby and during power OFF.

As illustrated in FIG. 9, the liquid supply pipe 244 is linked with a liquid supply tank 260. The liquid supply pipe 244 is also equipped with a liquid supply pump 262. The liquid supply pump 262 pumps the moisturizer 202 stored in the liquid supply tank 260 into the first middle liquid chamber 234. The liquid supply pipe 244 is further equipped with a liquid supply valve (not illustrated) which can turn on (supply)/off (stop) supply of the moisturizer 202. The liquid supply valve is constituted of a solenoid valve, for example. The number of the liquid supply ports 224 and their arrangement places are not particularly limited as long as the moisturizer 202 stored in the liquid supply tank 260 can appropriately be supplied to the first middle liquid chamber 234.

Both the waste liquid pipe 246 and the waste liquid pipe 248 join a waste liquid collection pipe 156 which connects a waste liquid tray 154 and a waste liquid tank 158. The waste liquid collection pipe 156 is equipped with a waste liquid pump 264. The waste liquid pump 264 pumps the moisturizer 202 stored in the first middle liquid chamber 234, the second middle liquid chamber 236, and the waste liquid tray 154 into the waste liquid tank 158. The waste liquid collection pipe 156 is further equipped with a waste liquid valve (not illustrated) which can turn on (collect)/off (stop) collection of the moisturizer 202. The waste liquid valve is constituted of a solenoid valve, for example.

(To Supply Moisturizer)

In the cap 70 configured as described before, the liquid supply valve and the waste liquid valve are normally closed.

To supply the moisturizer 202 to the cap 70, the liquid supply valve is opened and the liquid supply pump 262 (one example of the supply device) is operated. As a consequence, the moisturizer 202 stored in the liquid supply tank 260 is supplied to and stored in the first middle liquid chamber 234.

As the moisturizer 202 continues to be supplied by the liquid supply pump 262, the supplied amount soon reaches a maximum capacity of the first middle liquid chamber 234, and the moisturizer 202 overflows from an upper edge portion of the partition plate 222 (one example of the supply device). The moisturizer 202 flowing over the partition plate 222 from the first middle liquid chamber 234 flows into the second middle liquid chamber 236 and is stored in the second middle liquid chamber 236.

As the moisturizer 202 continues to be supplied, the supply amount soon exceeds a maximum capacity of the second middle liquid chamber 236, and the moisturizer 202 overflows from an upper edge portion of the lower plate 220D of the second liquid retainer 220 (one example of the supply device). The moisturizer 202 flowing over the lower plate 220D from the second middle liquid chamber 236 flows into the lowermost liquid chamber 238 and is stored in the lowermost liquid chamber 238.

As the moisturizer 202 further continues to be supplied, the supply amount soon exceeds a maximum capacity of the lowermost liquid chamber 238, and the moisturizer 202 overflows from the overflow port 211 of the lower plate 210D in the first liquid retainer 210. The moisturizer 202 flowing over the lower plate 210D from the lowermost liquid chamber 238 flows into the waste liquid tray 154 (one example of the waste fluid retainer).

While the moisturizer 202 is stored in the liquid chambers, the uppermost liquid chamber 232 and a gas space 238A of the lowermost liquid chamber 238 in which the moisturizer 202 is not stored are linked through a region which is different from a region on an open surface side of the first middle liquid chamber 234 and the second middle liquid chamber 236 and which is formed between the bottom plate 210B and the bottom plate 220B (one example of the region on the back surface side of the middle liquid chamber, one example of the region between the first bottom plate and the second bottom plate).

To stop supply of the moisturizer, the liquid supply pump 262 is stopped and the liquid supply valve is closed.

Thus, in the cap 70, the first middle liquid chamber 234 (one example of the uppermost middle liquid chamber) on the uppermost stage side in the perpendicular direction is supplied with the moisturizer 202 by the liquid supply pump 262, and the moisturizer 202 then sequentially flows into the second middle liquid chamber 236 and the lowermost liquid chamber 238 on the lower side in the perpendicular direction as the moisturizer 202 overflows. As a consequence, the moisturizer 202 can be supplied to the entire cap 70 with only one liquid supply system (liquid supply tank 260-liquid supply pipe 244-first middle liquid chamber 234) from the liquid supply tank 260. Therefore, supply of the moisturizer 202 can be implemented with a simplified configuration.

(To Moisturize Head)

During power OFF and printing standby, the head 50 is retained at a head moisturizing position illustrated in FIG. 9. As illustrated in FIG. 9, at the head moisturizing position, the first middle liquid chamber 234 and the second middle liquid chamber 236 of the cap 70 are arranged at a position facing the nozzle region 126A of the nozzle surface 52, and the uppermost liquid chamber 232 and the lowermost liquid chamber 238 of the cap 70 are arranged at a position facing the non-nozzle region 126B.

In this case, the moisturizer 202 stored in the first middle liquid chamber 234 and the moisturizer 202 stored in the second middle liquid chamber 236 form step-like liquid surfaces across the partition plate 222. Similarly, the moisturizer 202 stored in the second middle liquid chamber 236 and the moisturizer 202 stored in the lowermost liquid chamber 238 form step-like liquid surfaces across the lower plate 220D. Thus, the moisturizer 202 has the liquid surfaces formed with a height difference in the direction of inclination Therefore, the liquid surface of the moisturizer 202 stored in the first middle liquid chamber 234 and the liquid surface of the moisturizer 202 stored in the second middle liquid chamber 236 closely face the nozzle region 126A, and the liquid surface of the moisturizer 202 stored in the lowermost liquid chamber 238 closely faces the non-nozzle region 126B on the lower side in the perpendicular direction of the nozzle surface 52. Although the nozzle surface 52 inclines relative to the horizontal plane, the partition plate 222 and the lower plate 220D can make the liquid surface of the moisturizer 202 closely face the nozzle surface 52 in this way. This makes it possible to increase relative humidity in the periphery of the nozzle unit and to prevent the inks inside the nozzles from being solidified.

In this case, the moisturizer 202 is not stored in the uppermost liquid chamber 232 which closely faces the non-nozzle region 126B on the upper side in the perpendicular direction of the nozzle surface 52. However, since the uppermost liquid chamber 232 and the gas space 238A of the lowermost liquid chamber 238 are linked through a region formed between the bottom plate 210B and the bottom plate 220B, the non-nozzle region 126B facing the uppermost liquid chamber 232 can also be moisturized with steam (steam of the moisturizer stored in the lowermost liquid chamber 238) of the gas space 238A.

According to the cap 70, the region which links the uppermost liquid chamber 232 and the gas space 238A of the lowermost liquid chamber 238 has a large cross section (linked area) in particular, which provides a significant effect of moisturizing the non-nozzle region 126B which faces the uppermost liquid chamber 232.

(To Discharge Moisturizer)

At the head moisturizing position, the inks in the head 50 can be pressure-purged periodically or irregularly. The purged inks are separated from the nozzle surface 52 and are received by the first middle liquid chamber 234 and the second middle liquid chamber 236 which face the nozzle region 126A. The inks which turn into mist during pressure-purging may mix into the moisturizer stored in the lowermost liquid chamber 238. Therefore, when the moisturizer 202 of the cap 70 is contaminated with inks, the moisturizer 202 needs to be discharged.

To discharge the moisturizer 202 in the cap 70, the waste liquid valve is opened and the waste liquid pump 264 (one example of the discharge device) is operated. As a consequence, the moisturizer stored in the first middle liquid chamber 234, the second middle liquid chamber 236, and the waste liquid tray 154 are collected from the waste liquid pipe 246 and the waste liquid pipe 248 and through the waste liquid collection pipe 156 into the waste liquid tank 158. To stop discharge of the moisturizer, the waste liquid pump 264 is stopped and the waste liquid valve is closed.

When pressure purge is performed at the head moisturizing position, the inks pushed out from the nozzles are discharged into the first middle liquid chamber 234 and the second middle liquid chamber 236 which are arranged at the position facing the nozzle region 126A of the nozzle surface 52. Hence, although the moisturizer stored in the first middle liquid chamber 234 and the second middle liquid chamber 236 are contaminated with inks during pressure-purging, the contaminated moisturizer can be collected into the waste liquid tank 158.

More specifically, since the cap 70 includes waste liquid systems (first middle liquid chamber 234-waste liquid pipe 246-waste liquid tank 158, second middle liquid chamber 236-waste liquid pipe 248-waste liquid tank 158) for the plurality of middle liquid chambers, the moisturizer 202 can appropriately be discharged.

On the contrary, the moisturizer is not stored in the uppermost liquid chamber 232. If the moisturizer stored in the lowermost liquid chamber 238 is contaminated with ink, this contamination propagates to neither the first middle liquid chamber 234 nor the second middle liquid chamber 236. Therefore, the waste liquid systems of the uppermost liquid chamber 232 and the lowermost liquid chamber 238 can be omitted, so that the apparatus can be simplified.

Although two middle liquid chambers (the first middle liquid chamber 234 and the second middle liquid chamber 236) are provided in the direction of inclination in the present embodiment, the number of middle liquid chambers may be one or may be three or more.

<Modification of First Embodiment>

The second liquid retainer 220 of the cap 70 is supported by the first liquid retainer 210 while the right side plate 220R and the left side plate 220L are in contact with the right side plate 210R and the left side plate 210L of the first liquid retainer 210, respectively. However, the second liquid retainer 220 may be supported by other methods.

Figure 10:
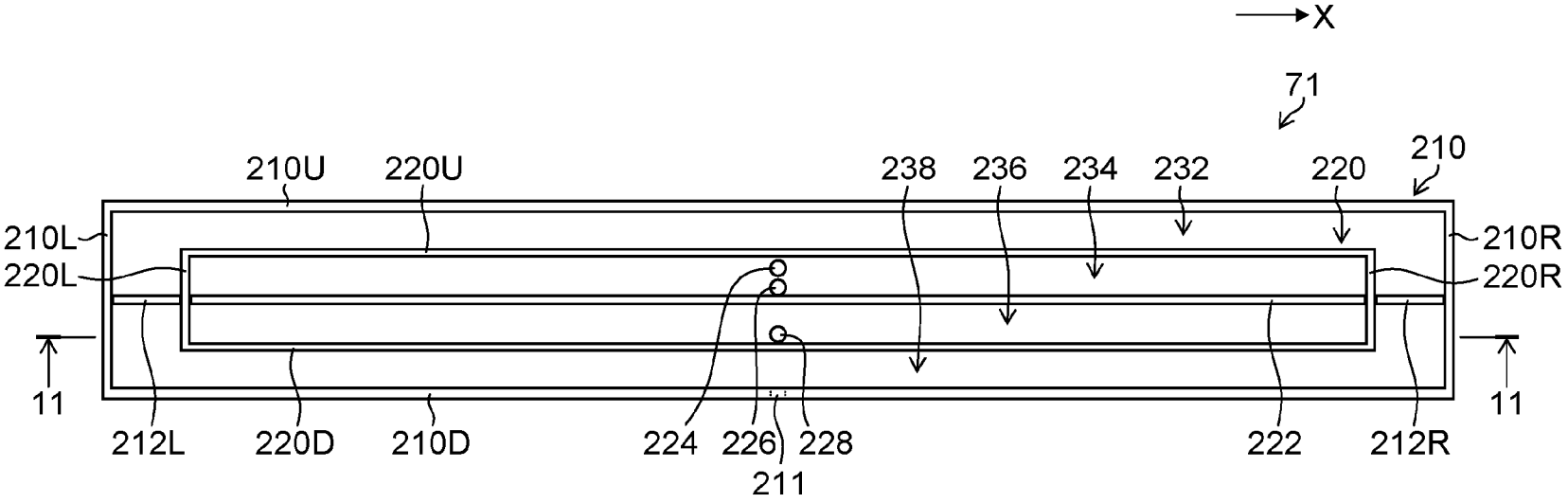
FIG. 10 illustrates a cap as viewed from the open surface side.
Figure 11:
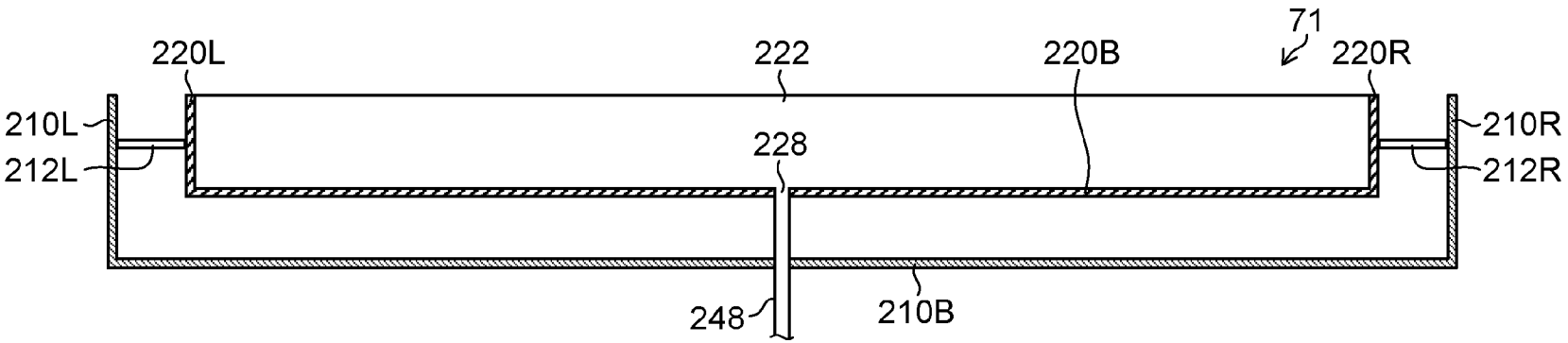
FIG. 11 is a cross sectional view of the cap along a 11-11 line of FIG. 10.

For example, a cap 71 illustrated in FIGS. 10 and 11 is supported by the first liquid retainer 210 using support members 212R and 212L provided in the right side plate 210R and the left side plate 210L. With this configuration, the second liquid retainer 220 may be supported while the bottom plate 210B and the bottom plate 220B are arranged in parallel at a constant interval.

In the case of the cap 71, the uppermost liquid chamber 232 and the gas space 238A of the lowermost liquid chamber 238 are linked through a region formed between the bottom plate 210B and the bottom plate 220B, and are also linked through a region partitioned with the bottom plate 210B, the right side plate 210R, and the right side plate 220R and through a region partitioned with the bottom plate 210B, the left side plate 210L, and the left side plate 220L (one example of the region on the lateral surface side of the middle liquid chamber, one example of the region between the first side plate and the second side plate, the region being different from the region on the side of the uppermost liquid chamber and the region on the side of the lowermost liquid chamber). Therefore, the cross section of the region which links the uppermost liquid chamber 232 and the gas space 238A of the lowermost liquid chamber 238 is larger than that of the cap 70, so that a significant moisturizing effect is provided.

The support member raised on the bottom plate 210B may also support the second liquid retainer 220 while the bottom plate 210B and the bottom plate 220B are arranged in parallel at a constant interval.

<Second Embodiment>

A description is given of a cap 72 according to a second embodiment. Component members in common with those of the cap 70 are designated by identical reference numerals to omit a detailed description thereof. The cap 72 is provided for each of the heads in the moisturizing unit 60 as in the first embodiment.

Figure 12:
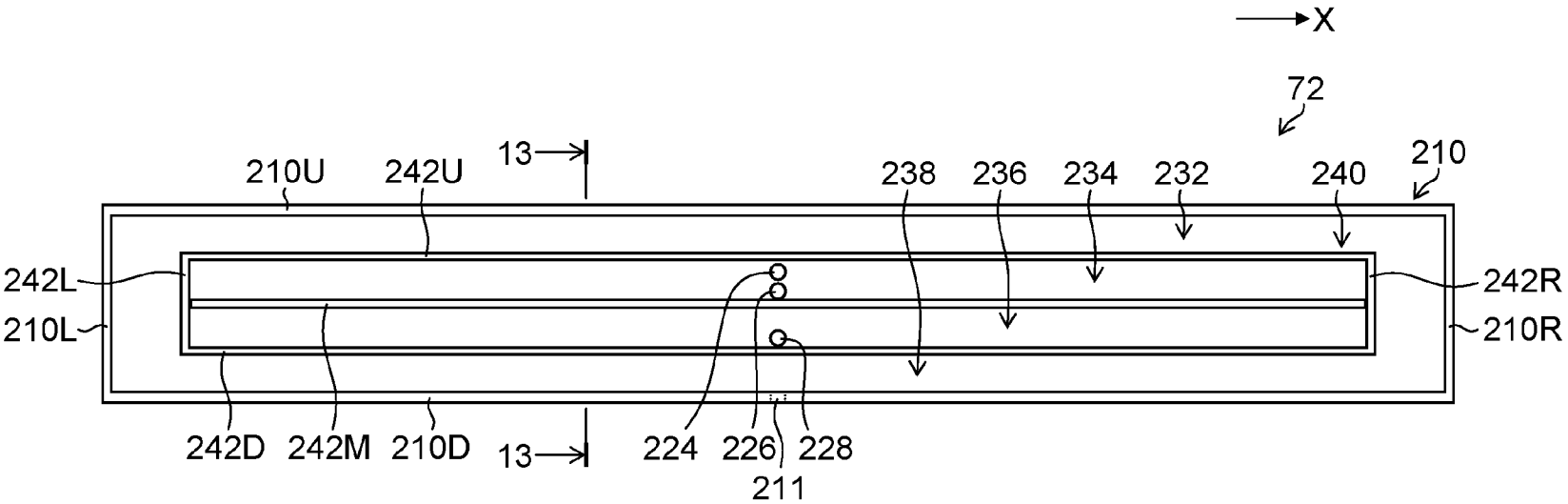
FIG. 12 illustrates a cap as viewed from the open surface side (as viewed from an arrow line B of FIG. 13)
Figure 13:
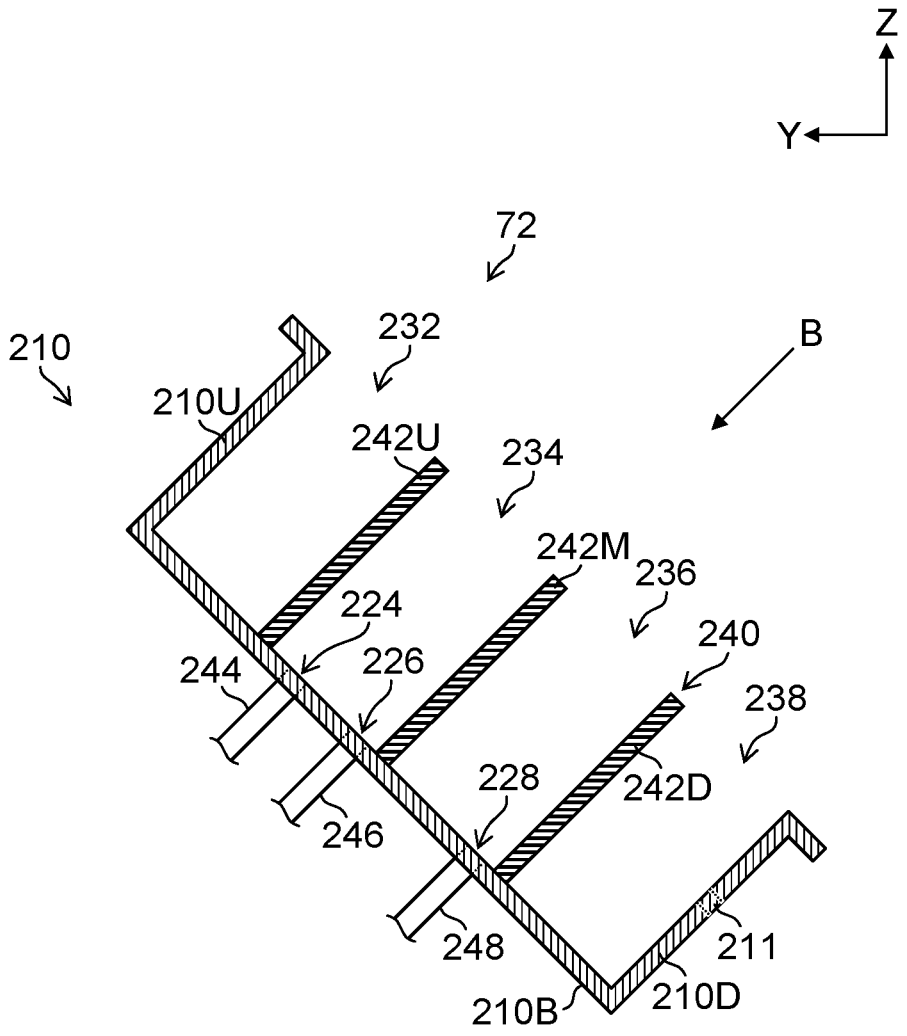
FIG. 13 is a cross sectional view of the cap along a 13-13 line of FIG. 12.

The cap 72 is arranged to be inclined relative to the horizontal plane in accordance with an angle of inclination of a nozzle surface 52 inclined relative to the horizontal plane. As illustrated in FIGS. 12 and 13, the cap 72 includes a first liquid retainer 210 which is a hollow box-shaped member with one face being opened.

On a bottom plate 210B of the first liquid retainer 210, a pair of a right partition plate 242R and a left partition plate 242L are raised in a direction parallel to a right side plate 210R and a left side plate 210L. In the direction parallel to an upper plate 210U and a lower plate 210D, an upper partition plate 242U, a middle partition plate 242M, and a lower partition plate 242D are raised to be in contact with the bottom plate 210B, the right partition plate 242R, and the left partition plate 242L without any clearance. As a consequence, a surrounded region 240 surrounded with the bottom plate 210B, the upper partition plate 242U, the right partition plate 242R, the lower partition plate 242D, and the left partition plate 242L (one example of the second side plate) is formed inside the first liquid retainer 210. Here, a distance between the upper partition plate 242U and the lower partition plate 242D is identical to the width $W_N$ in Y direction of the nozzle region 126A in the inkjet head 50. The distance between the upper partition plate 242U and the lower partition plate 242D may be set larger than $W_N$.

In the cap 72 configured in this way, there are formed: a first middle liquid chamber 234 partitioned with the bottom plate 210B, the right partition plate 242R, the left partition plate 242L, the upper partition plate 242U, and the middle partition plate 242M; and a second middle liquid chamber 236 partitioned with the bottom plate 210B, the right partition plate 242R, the left partition plate 242L, the middle partition plate 242M, and the lower partition plate 242D. More specifically, the surrounded region 240 is divided by the middle partition plate 242M into a plurality of regions in the inclination direction of the cap 72. The first middle liquid chamber 234 is formed on the upper side in the inclination direction, and the second middle liquid chamber 236 is formed on the lower side in the inclination direction.

Furthermore, in the cap 72, there are formed: an uppermost liquid chamber 232 partitioned with the bottom plate 210B, the right side plate 210R, the left side plate 210L, the upper plate 210U, and the upper partition plate 242U; and a lowermost liquid chamber 238 partitioned with the bottom plate 210B, the right side plate 210R, the left side plate 210L, the lower partition plate 242D, and the lower plate 210D. More specifically, the first middle liquid chamber 234 and the second middle liquid chamber 236 are arranged between the uppermost liquid chamber 232 and the lowermost liquid chamber 238.

The uppermost liquid chamber 232 and the lowermost liquid chamber 238 are linked through a region different from a region on the open surface side of the first middle liquid chamber 234 and the second middle liquid chamber 236, the region being partitioned with the bottom plate 220B, the right side plate 210R, and the right partition plate 242R (one example of the region on the lateral surface side of the middle liquid chamber, one example of the region between the first side plate and the second side plate, the region being different from the region on the side of the uppermost liquid chamber and the region on the side of the lowermost liquid chamber) and through a region partitioned with the bottom plate 220B, the left side plate 210L, and the left partition plate 242L (one example of the region on the lateral surface side of the middle liquid chamber, one example of the region between the first side plate and the second side plate, the region being different from the region on the side of the uppermost liquid chamber and the region on the side of the lowermost liquid chamber).

The first middle liquid chamber 234 has a liquid supply port 224 and a waste liquid port 226 provided in the bottom plate 210B. The second middle liquid chamber 236 has a waste liquid port 228 provided in the bottom plate 220B. The liquid supply port 224, the waste liquid port 226, and the waste liquid port 228 are connected to a liquid supply pipe 244, a waste liquid pipe 246, and a waste liquid pipe 248, respectively.

Figure 14:
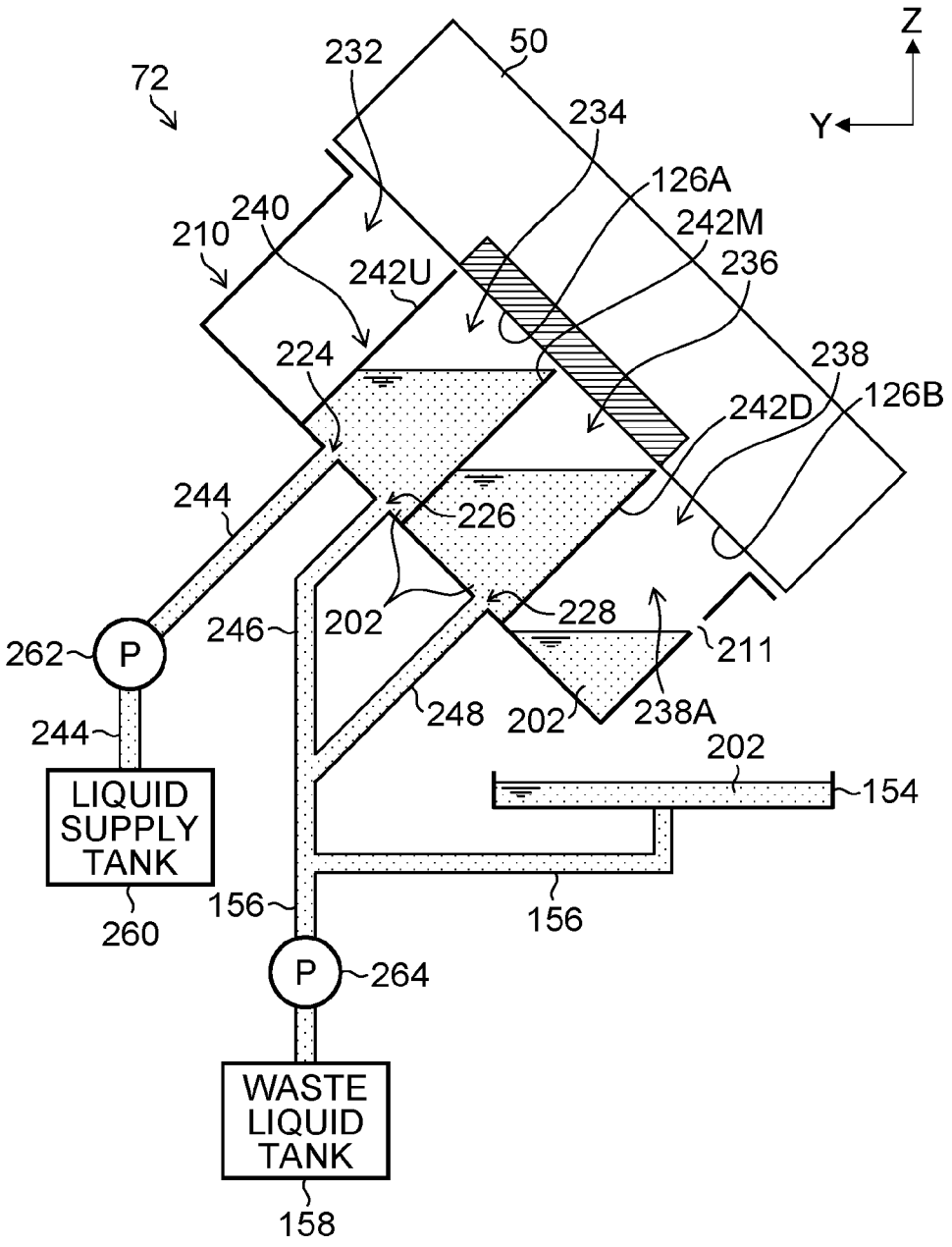
FIG. 14 is a sectional side view illustrating the head in a moisturized state at such time as during printing standby and during power OFF.

As illustrated in FIG. 14, the liquid supply pipe 244, the waste liquid pipe 246, and the waste liquid pipe 248 are connected in the same way as in the cap 70 illustrated in FIG. 9. The moisturizer 202 may also be supplied and discharged in the same way as in the case of the cap 70. More specifically, the first middle liquid chamber 234 is supplied with the moisturizer 202 by a liquid supply pump 262, and the second middle liquid chamber 236 and the lowermost liquid chamber 238 are supplied with the moisturizer 202 by overflow of the moisturizer 202. The moisturizer 202 in the first middle liquid chamber 234 and the second middle liquid chamber 236 is discharged by a waste liquid pump 264.

At the head moisturizing position, the first middle liquid chamber 234 and the second middle liquid chamber 236 of the cap 72 are arranged at a position facing the nozzle region 126A of the nozzle surface 52, and the uppermost liquid chamber 232 and the lowermost liquid chamber 238 of the cap 72 are arranged at a position facing the non-nozzle region 126B.

In this case, the moisturizer 202 stored in the first middle liquid chamber 234 and the moisturizer 202 stored in the second middle liquid chamber 236 form step-like liquid surfaces across the middle partition plate 242M. Similarly, the moisturizer 202 stored in the second middle liquid chamber 236 and the moisturizer 202 stored in the lowermost liquid chamber 238 form step-like liquid surfaces across the lower partition plate 242D. Thus, the moisturizer 202 has the liquid surfaces formed with a height difference in the direction of inclination.

Therefore, the liquid surface of the moisturizer 202 stored in the first middle liquid chamber 234 and the liquid surface of the moisturizer 202 stored in the second middle liquid chamber 236 closely face the nozzle region 126A, and the liquid surface of the moisturizer 202 stored in the lowermost liquid chamber 238 closely faces the non-nozzle region 126B on the lower side in the perpendicular direction of the nozzle surface 52. Although the nozzle surface 52 inclines relative to the horizontal plane, the middle partition plate 242M and the lower partition plate 242D can make the liquid surface of the moisturizer 202 closely face the nozzle surface 52 in this way. This makes it possible to increase relative humidity in the periphery of the nozzle unit and to prevent the inks inside the nozzles from being solidified.

Moreover, the moisturizer 202 is not stored in the uppermost liquid chamber 232 which closely faces the non-nozzle region 126B on the upper side in the perpendicular direction of the nozzle surface 52. However, the uppermost liquid chamber 232 and the gas space 238A of the lowermost liquid chamber 238 are linked through a region partitioned with the bottom plate 220B, the right side plate 210R, and the right partition plate 242R and through a region partitioned with the bottom plate 220B, the left side plate 210L, and the left partition plate 242L. Accordingly, the non-nozzle region 126B which faces the uppermost liquid chamber 232 may be moisturized with steam of the gas space 238A.

The cap 72 is smaller in the cross section of a region which links the uppermost liquid chamber 232 and the lowermost liquid chamber 238 than the cap 70, and therefore the cap 72 is slightly inferior to the cap 70 in terms of the moisturizing effect. However, the cap 72 can advantageously achieve cost reduction since the cap 72 can easily be manufactured as compared with the cap 70 having dual configuration (configuration in which the second liquid retainer 220 is provided inside the first liquid retainer 210).

<Third Embodiment>

A description is given of a cap 74 according to a third embodiment. Component members in common with those of the cap 70 are designated by identical reference numerals to omit a detailed description thereof. The cap 74 is provided for each of the heads in the moisturizing unit 60 as in the first embodiment.

Figure 15:
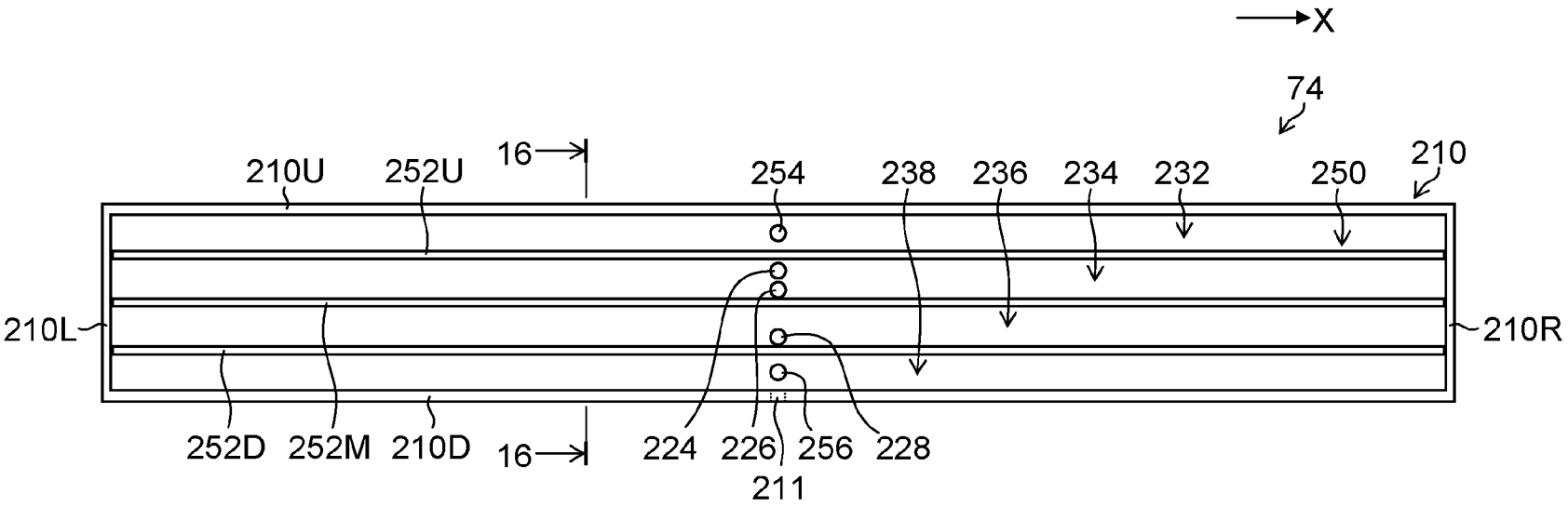
FIG. 15 illustrates a cap as viewed from the open surface side (as viewed from an arrow line C of FIG. 16)
Figure 16:
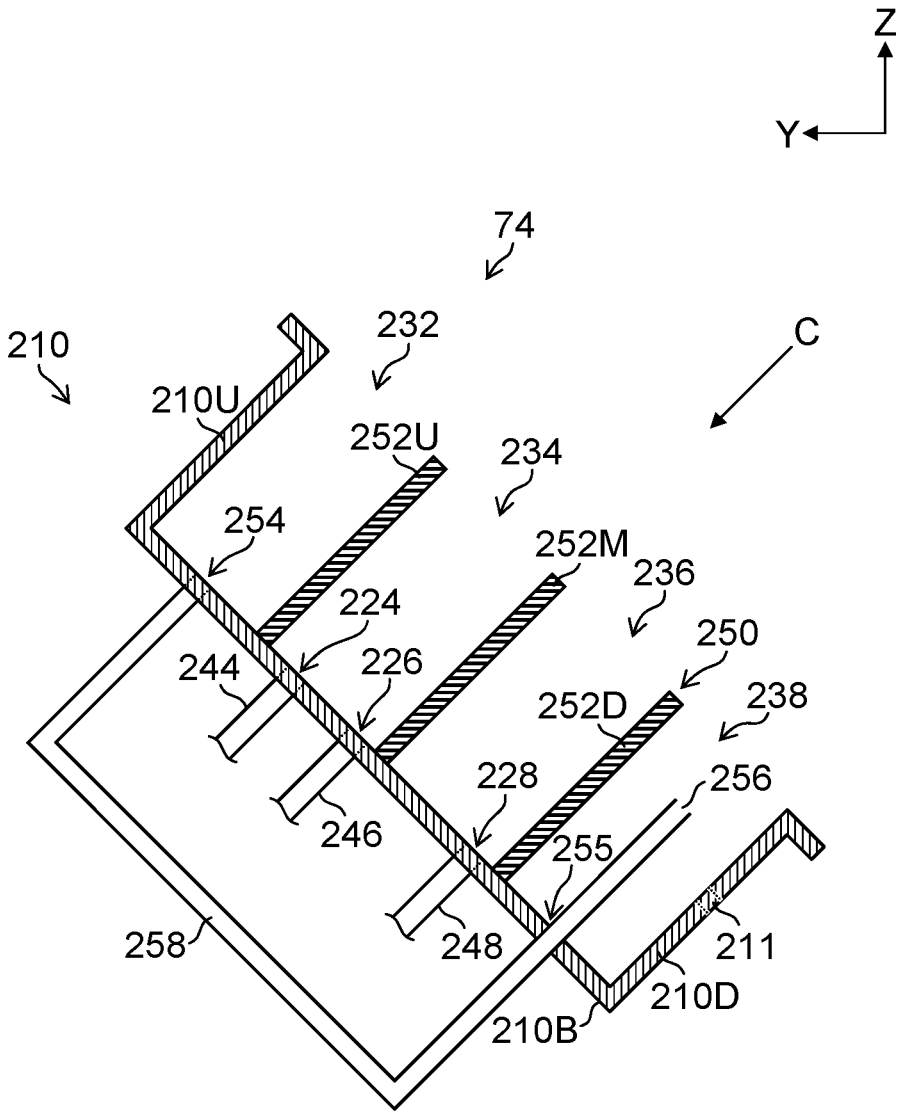
FIG. 16 is a cross sectional view of the cap along a 16-16 line of FIG. 15.

The cap 74 is arranged to be inclined relative to the horizontal plane in accordance with an angle of inclination of a nozzle surface 52 inclined relative to the horizontal plane. As illustrated in FIGS. 15 and 16, the cap 74 includes a first liquid retainer 210 which is a hollow box-shaped member with one face being opened.

The first liquid retainer 210 is divided into a plurality of liquid chambers by a partitioning member 250. Specifically, the first liquid retainer 210 has an upper partition plate 252U, a middle partition plate 252M, and a lower partition plate 252D raised to be in contact with a bottom plate 210B, a right side plate 210R and a left side plate 210L without any clearance in a direction parallel to an upper plate 210U and a lower plate 210D. Here, a distance between the upper partition plate 252U and the lower partition plate 252D is identical to a width $W_N$ in Y direction of the nozzle region 126A in the inkjet head 50. The distance between the upper partition plate 252U and the lower partition plate 252D may be set larger than $W_N$.

In the cap 74 configured in this way, there are formed: an uppermost liquid chamber 232 partitioned with the bottom plate 210B, the right side plate 210R, the left side plate 210L, the upper plate 210U, and the upper partition plate 252U; a first middle liquid chamber 234 partitioned with the bottom plate 210B, the right side plate 210R, the left side plate 210L, the upper partition plate 252U, and the middle partition plate 252M; a second middle liquid chamber 236 partitioned with the bottom plate 210B, the right side plate 210R, the left side plate 210L, the middle partition plate 25M, and the lower partition plate 25D; and a lowermost liquid chamber 238 partitioned with the bottom plate 210B, the right side plate 210R, the left side plate 210L, the lower partition plate 252D, and the lower plate 210D.

More specifically, the first liquid retainer 210 is divided into a plurality of regions with the upper partition plate 252U, the middle partition plate 252M, and the lower partition plate 252D. Along the direction of inclination of the cap 74, the uppermost liquid chamber 232 is arranged on an uppermost stage in a perpendicular direction, the lowermost liquid chamber 238 is arranged on a lowermost stage in the perpendicular direction, and the first middle liquid chamber 234 and the second middle liquid chamber 236 are arranged between the uppermost liquid chamber 232 and the lowermost liquid chamber 238.

The uppermost liquid chamber 232 includes an exhaust port 254 provided in the bottom plate 210B, and the exhaust port 254 is connected to an air supply pipe 258. The air supply pipe 258 penetrates a through hole 255 provided in the bottom plate 210B of the lowermost liquid chamber 238, and an air supply port 256 that is a tip of the air supply pipe 258 is arranged at a position separated from the bottom plate 210B of the lowermost liquid chamber 238. Therefore, the uppermost liquid chamber 232 and the lowermost liquid chamber 238 are linked through the air supply pipe 258 provided in a region on the back surface side of the first middle liquid chamber 234 and the second middle liquid chamber 236.

The exhaust port 254 and the through hole 255 may be provided in the right side plate 210R or the left side plate 210L, and the air supply pipe 258 may be provided in the lateral surface side of the first middle liquid chamber 234 and the second middle liquid chamber 236.

The first middle liquid chamber 234 has a liquid supply port 224 and a waste liquid port 226 provided in the bottom plate 210B. The second middle liquid chamber 236 has a waste liquid port 228 provided in the bottom plate 220B. The liquid supply port 224, the waste liquid port 226, and the waste liquid port 228 are connected to a liquid supply pipe 244, a waste liquid pipe 246, and a waste liquid pipe 248, respectively.

Figure 17:
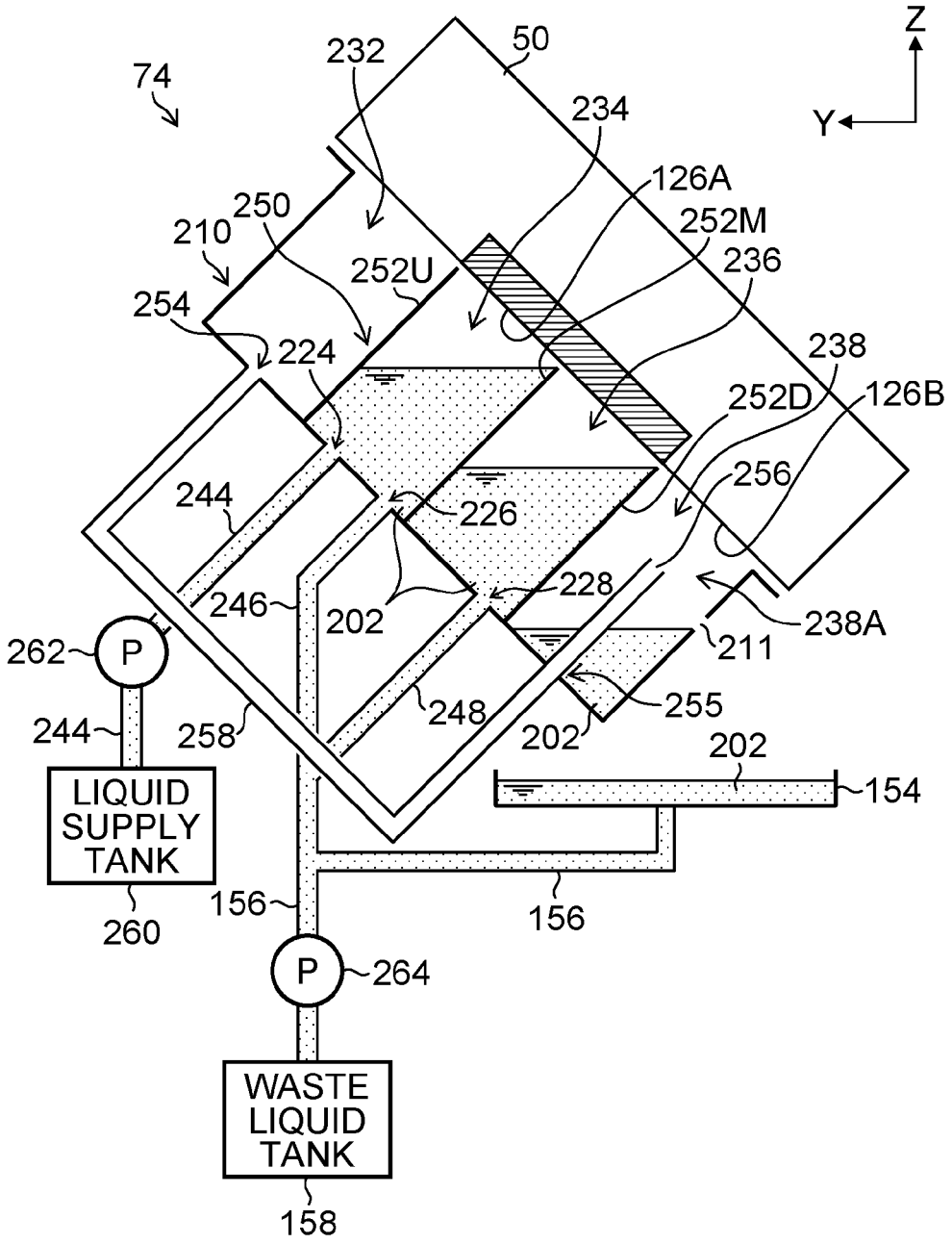
FIG. 17 is a sectional side view illustrating the head in a moisturized state at such time as during printing standby and during power OFF.

As illustrated in FIG. 17, the liquid supply pipe 244, the waste liquid pipe 246, and the waste liquid pipe 248 are connected in the same way as in the cap 70 illustrated in FIG. 9. The moisturizer 202 may also be supplied and discharged in the same way as in the case of the cap 70. More specifically, the first middle liquid chamber 234 is supplied with the moisturizer 202 with a liquid supply pump 262, and the second middle liquid chamber 236 and the lowermost liquid chamber 238 are supplied with the moisturizer 202 by overflow of the moisturizer 202.

While the moisturizer 202 is stored in the lowermost liquid chamber 238, the air supply port 256 of the air supply pipe 258 is arranged above the liquid surface of the moisturizer 202 in the perpendicular direction and is linked with the gas space 238A.

The moisturizer 202 in the first middle liquid chamber 234 and the second middle liquid chamber 236 is discharged by a waste liquid pump 264.

At the head moisturizing position, the first middle liquid chamber 234 and the second middle liquid chamber 236 of the cap 74 are arranged at a position facing the nozzle region 126A of the nozzle surface 52, and the uppermost liquid chamber 232 and the lowermost liquid chamber 238 of the cap 74 are arranged at a position facing the non-nozzle region 126B.

In this case, the moisturizer 202 stored in the first middle liquid chamber 234 and the moisturizer 202 stored in the second middle liquid chamber 236 form step-like liquid surfaces across the middle partition plate 252M. Similarly, the moisturizer 202 stored in the second middle liquid chamber 236 and the moisturizer 202 stored in the lowermost liquid chamber 238 form step-like liquid surfaces across the lower partition plate 252D. Thus, the moisturizer 202 has the liquid surfaces formed with a height difference in the direction of inclination.

Therefore, the liquid surface of the moisturizer 202 stored in the first middle liquid chamber 234 and the liquid surface of the moisturizer 202 stored in the second middle liquid chamber 236 closely face the nozzle region 126A, and the liquid surface of the moisturizer 202 stored in the lowermost liquid chamber 238 closely faces the non-nozzle region 126B on the lower side in the perpendicular direction of the nozzle surface 52. Although the nozzle surface 52 inclines relative to the horizontal plane, the middle partition plate 252M and the lower partition plate 252D can make the liquid surfaces of the moisturizer 202 closely face the nozzle surface 52 in this way. This makes it possible to increase relative humidity in the periphery of the nozzle unit and to prevent the inks inside the nozzles from being solidified.

Moreover, the moisturizer 202 is not stored in the uppermost liquid chamber 232 which closely faces the non-nozzle region 126B on the upper side in the perpendicular direction of the nozzle surface 52. However, since the uppermost liquid chamber 232 and the gas space 238A of the lowermost liquid chamber 238 are linked through the air supply pipe 258, the non-nozzle region 126B which faces the uppermost liquid chamber 232 may also be moisturized with steam of the gas space 238A.

The cap 74 is smaller in the cross section of a region which links the uppermost liquid chamber 232 and the lowermost liquid chamber 238 than the cap 70 and the cap 72, and therefore the cap 74 is slightly inferior to the cap 70 and the cap 72 in terms of the moisturizing effect. However, the cap 74 is advantageously larger in layout flexibility of the air supply pipe 258.

The sizes, the number, and the arrangement places of the exhaust ports 254 and the through holes 255, as well as the diameter of the air supply pipe 258 are not particularly limited. As the sizes of the exhaust port 254 and the through hole 255 are larger and as the number thereof is larger, the cross section of the region which links the uppermost liquid chamber 232 and the gas space 238A of the lowermost liquid chamber 238 becomes larger, which enhances the effect of moisturizing the non-nozzle region 126B which faces the uppermost liquid chamber 232.

<Comparison with Caps in Comparative Examples>

Figure 18:
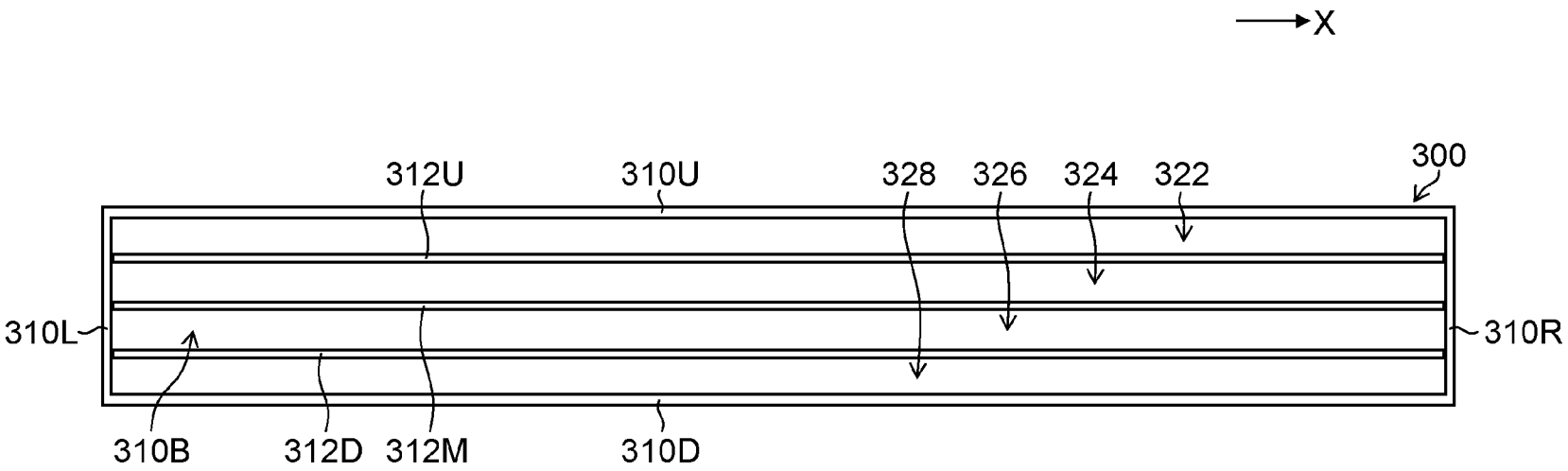
FIG. 18 illustrates a liquid retainer of a cap according to a comparative example as viewed from the open surface side.

The caps 76, 77, 78, and 79 (see FIGS. 19 to 22) according to comparative examples includes a liquid retainer 300 which is a hollow box-shaped member with one face being opened as illustrated in FIG. 18. The liquid retainer 300 has a rectangular parallelepiped shape formed of: a rectangular bottom plate 310B; a pair of a right side plate 31 OR and a left side plate 310L which are provided at right angles with respect to the peripheries of the sides extending in X direction of the bottom plate 310B so as to face each other; and a pair of an upper plate 310U and a lower plate 310D which are provided at right angles with respect to the peripheries of the sides orthogonal to the sides extending in X direction of the bottom plate 310B so as to face each other.

Moreover, the liquid retainer 300 has an upper partition plate 312U, a middle partition plate 312M, and a lower partition plate 312D raised to be in contact with the bottom plate 310B, the right side plate 31 OR and the left side plate 310L without any clearance in a direction parallel to the upper plate 310U and the lower plate 310D.

As a result, in the liquid retainer 300, there are formed: an uppermost liquid chamber 322 partitioned with the bottom plate 310B, the right side plate 310R, the left side plate 310L, the upper plate 310U, and the upper partition plate 312U; a first middle liquid chamber 324 partitioned with the bottom plate 310B, the right side plate 310R, the left side plate 310L, the upper partition plate 312U, and the middle partition plate 312M; a second middle liquid chamber 326 partitioned with the bottom plate 310B, the right side plate 310R, the left side plate 310L, the middle partition plate 312M, and the lower partition plate 312D; and a lowermost liquid chamber 328 partitioned with the bottom plate 310B, the right side plate 310R, the left side plate 310L, the lower partition plate 312D, and the lower plate 310D.

In the caps 76, 77, 78, and 79 according to the comparative examples, the first middle liquid chamber 324 and the second middle liquid chamber 326 face the nozzle region 126A, and the uppermost liquid chamber 322 and the lowermost liquid chamber 328 face the nozzle region 126A at the moisturizing position of the head 50.

Hereinafter, the caps 76, 77, 78, and 79 according to the comparative examples illustrated in FIGS. 19 to 22, and the caps 70, 71, 72, and 74 according to the present embodiments described in the foregoing were evaluated in view of each point including moisturization of the head 50, the number of liquid supply systems of the moisturizer 202, the number of waste liquid systems of the moisturizer 202, the time taken for replacing the moisturizer 202, the amount of the moisturizer 202 needed for replacing the moisturizer 202, and contamination of the moisturizer 202 in the first middle liquid chamber 324 and the second middle liquid chamber 326 after replacement of the moisturizer 202. The results of these evaluations are illustrated in FIG. 23.

Figure 19:
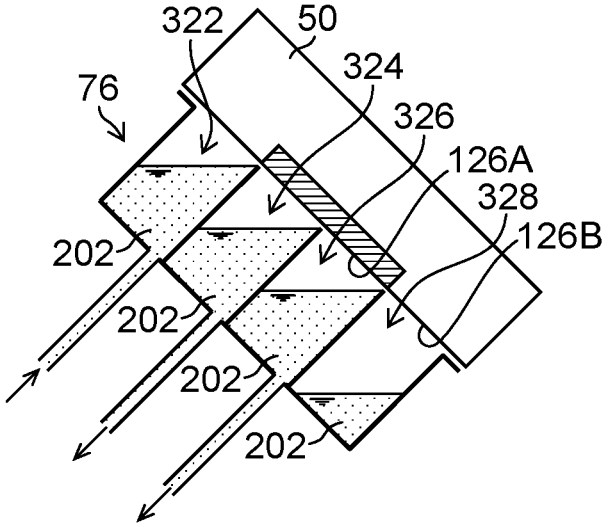
FIG. 19 illustrates a liquid supply system and a waste liquid system of the cap to supply/discharge the moisturizer according to the comparative example.

As illustrated in FIG. 19, the cap 76 is so configured that a liquid supply port of the moisturizer 202 is provided in the uppermost liquid chamber 322, and waste liquid ports of the moisturizer 202 are provided in the first middle liquid chamber 324 and the second middle liquid chamber 326 in the liquid retainer 300. The moisturizer 202 is first supplied to the uppermost liquid chamber 322 with a liquid supply pump (not illustrated), and then the moisturizer 202 is supplied to the first middle liquid chamber 324, the second middle liquid chamber 326, and the lowermost liquid chamber 328 by overflow of the moisturizer 202. The moisturizer 202 is discharged from the first middle liquid chamber 324 and the second middle liquid chamber 326 by a waste liquid pump (not illustrated).

In the cap 76 configured in this way, the moisturizer 202 is stored in the uppermost liquid chamber 322, the first middle liquid chamber 324, the second middle liquid chamber 326, and the lowermost liquid chamber 328. Accordingly, the cap 76 is preferable in view of moisturization of the head 50 (+++).

Next, as for the number of liquid supply systems of the moisturizer 202, there is one system connected to the uppermost liquid chamber 322. In view of this point, the cap 76 is preferable as a simplified configuration is achieved (+++). As for the number of waste liquid systems of the moisturizer 202, there are two systems connected to the middle liquid chambers. In view of this point, the cap 76 is preferable as a simplified configuration is achieved (+++).

Next, the time taken for replacing the moisturizer 202 inside the cap 76 is long by the time needed for supplying the moisturizer 202 to the uppermost liquid chamber 322, which makes the cap 76 not preferable (+). Similarly, the amount of the moisturizer 202 needed for replacement is also increased by the amount of the moisturizer 202 supplied to the uppermost liquid chamber 322, which makes the cap 76 not preferable (+).

Finally, in view of the contamination of the moisturizer 202 in the first middle liquid chamber 324 and the second middle liquid chamber 326 after replacement of the moisturizer 202, the cap 76 is less preferable (++) since the contamination of the moisturizer 202 stored in the uppermost liquid chamber 322 propagates to the first middle liquid chamber 324 by overflow of the moisturizer 202.

Figure 20:
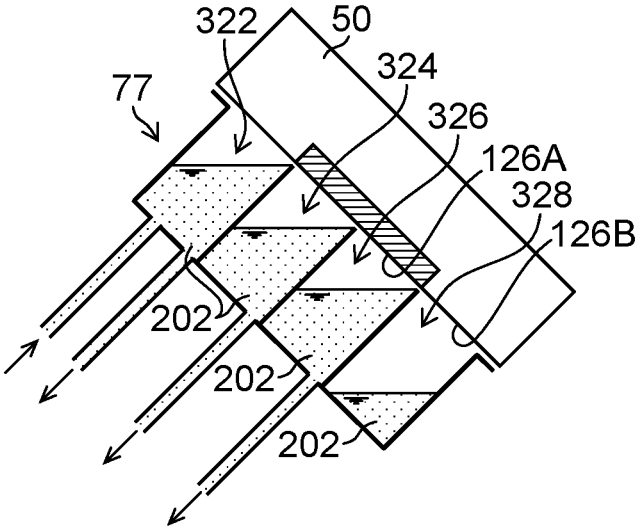
FIG. 20 illustrates a liquid supply system and a waste liquid system of a cap to supply/discharge the moisturizer according to a comparative example.

As illustrated in FIG. 20, the cap 77 is so configured that a liquid supply port of the moisturizer 202 is provided in the uppermost liquid chamber 322, and waste liquid ports of the moisturizer 202 are provided in the uppermost liquid chamber 322, the first middle liquid chamber 324, and the second middle liquid chamber 326 in the liquid retainer 300. The moisturizer 202 is supplied first to the uppermost liquid chamber 322 with a liquid supply pump (not illustrated), and is then supplied to the first middle liquid chamber 324, the second middle liquid chamber 326, and the lowermost liquid chamber 328 by overflow of the moisturizer 202. The moisturizer 202 is discharged from the uppermost liquid chamber 322, the first middle liquid chamber 324, and the second middle liquid chamber 326 by a waste liquid pump (not illustrated).

In the cap 77 configured in this way, the moisturizer 202 is stored in the uppermost liquid chamber 322, the first middle liquid chamber 324, the second middle liquid chamber 326, and the lowermost liquid chamber 328. Accordingly, the cap 77 is preferable in view of moisturization of the head 50 (+++).

Next, as for the number of liquid supply systems of the moisturizer 202, there is one system connected to the uppermost liquid chamber 322, so that the cap 77 is preferable as a simplified configuration is achieved (+++). As for the number of the waste liquid systems, as large as three waste liquid systems are provided, which makes the cap 77 not preferable (+).

Next, the time taken for replacing the moisturizer 202 inside the cap 77 is longer by the time needed for supplying the moisturizer 202 to the uppermost liquid chamber 322, which makes the cap 77 not preferable (+). Similarly, the amount of the moisturizer 202 needed for replacement is also increased by the amount of the moisturizer 202, which makes the cap 77 not preferable (+).

Finally, in view of the contamination of the moisturizer 202 in the first middle liquid chamber 324 and the second middle liquid chamber 326 after replacement of the moisturizer 202, contamination of the uppermost liquid chamber 322 does not propagate by overflow of the moisturizer 202 since the moisturizer 202 is directly discharged from the uppermost liquid chamber 322, which makes the cap 77 preferable (+++).

Figure 21:
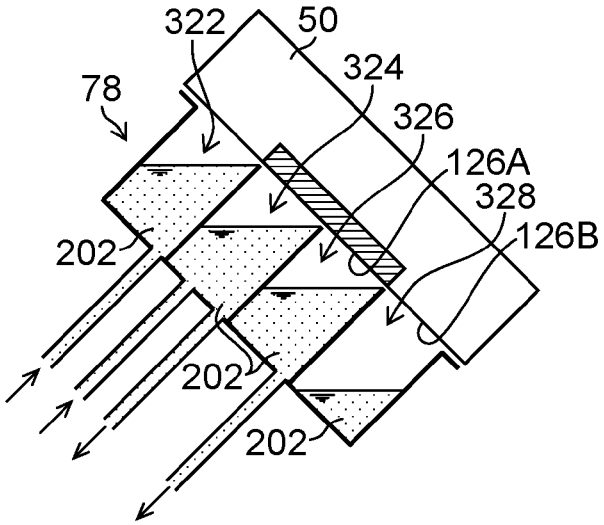
FIG. 21 illustrates a liquid supply system and a waste liquid system of a cap to supply/discharge the moisturizer according to a comparative example.

As illustrated in FIG. 21, the cap 78 is so configured that liquid supply ports of the moisturizer 202 are provided in the uppermost liquid chamber 322 and the first middle liquid chamber 324, and waste liquid ports of the moisturizer 202 are provided in the first middle liquid chamber 324 and the second middle liquid chamber 326 in the liquid retainer 300. The moisturizer 202 is supplied first to the uppermost liquid chamber 322 and the first middle liquid chamber 324 with a liquid supply pump (not illustrated), and is then supplied to the second middle liquid chamber 326 and the lowermost liquid chamber 328 by overflow of the moisturizer 202. The moisturizer 202 is discharged from the first middle liquid chamber 324 and the second middle liquid chamber 326 by a waste liquid pump (not illustrated).

In the cap 78 configured in this way, the moisturizer 202 is stored in each of storages, which makes the cap 78 preferable (+++) in view of moisturization of the head 50.

Next, as for the number of the liquid supply systems of the moisturizer 202, there are two systems connected to the uppermost liquid chamber 322 and the first middle liquid chamber 324, which makes the cap 78 not preferable (+). As for the number of the waste liquid systems of the moisturizer 202, two systems are provided in the middle liquid chambers, so that the cap 78 is preferable as a simplified configuration is achieved (+++).

Next, the time taken for replacing the moisturizer 202 inside the cap 78 is short since the moisturizer 202 can simultaneously be supplied to both the uppermost liquid chamber 322 and the first middle liquid chamber 324, which makes the cap 78 preferable (+++). Meanwhile, the amount of the moisturizer 202 needed for replacement is increased by the amount of the moisturizer 202 evaporated inside the uppermost liquid chamber 322, which makes the cap 78 less preferable (++).

Finally, in view of the contamination of the moisturizer 202 in the first middle liquid chamber 324 and the second middle liquid chamber 326 after replacement of the moisturizer 202, the contamination of the uppermost liquid chamber 322 does not propagate by overflow of the moisturizer 202 since the moisturizer 202 is directly discharged from the uppermost liquid chamber 322, which makes the cap 78 preferable (+++).

Figure 22:
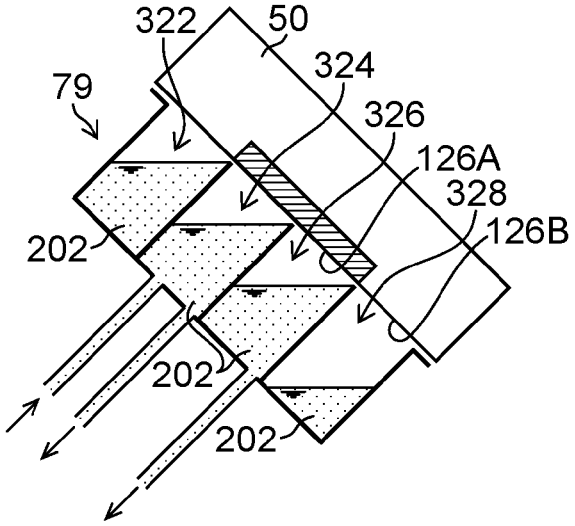
FIG. 22 illustrates the moisturizer supply system and the moisturizer discharge system of a cap according to the comparative example.

As illustrated in FIG. 22, the cap 79 is so configured that a liquid supply port of the moisturizer 202 is provided in the first middle liquid chamber 324, and waste liquid ports of the moisturizer 202 are provided in the first middle liquid chamber 324 and the second middle liquid chamber 326 in the liquid retainer 300. The moisturizer 202 is supplied first to the first middle liquid chamber 324 with a liquid supply pump (not illustrated), and is then supplied to the second middle liquid chamber 326 and the lowermost liquid chamber 328 by overflow of the moisturizer 202. The moisturizer 202 is discharged from the first middle liquid chamber 324 and the second middle liquid chamber 326 by a waste liquid pump (not illustrated).

In the cap 79 configured in this way, the moisturizer 202 is not stored in the uppermost liquid chamber 232, and therefore the nozzle surface facing the uppermost liquid chamber 232 cannot be moisturized, which makes the cap 79 not preferable in view of moisturization of the head 50 (+).

As for the number of liquid supply systems, one system is connected to the uppermost liquid chamber 322, so that the cap 79 is preferable as a simplified configuration is implemented (+++). As for the number of waste liquid systems, two systems are provided in the middle liquid chambers, so that the cap 79 is preferable as a simplified configuration is achieved (+++).

The time taken for replacing the moisturizer 202 inside the cap 79 is short since it is not necessary to supply the moisturizer 202 to the uppermost liquid chamber 322, which makes the cap 79 preferable (+++). As for the amount of the moisturizer 202 needed for replacement, the moisturizer 202 is needed only for the first middle liquid chamber 324, the second middle liquid chamber 326, and the lowermost liquid chamber 328, which makes the cap 79 preferable (+++).

Since the moisturizer 202 does not overflow from the uppermost liquid chamber 322, there is no contamination of the moisturizer 202 in the first middle liquid chamber 324 and the second middle liquid chamber 326 after replacement of the moisturizer 202, which makes the cap 79 preferable (+++).

According to the caps 70, 71, 72, and 74 in the present embodiments, the moisturizer 202 stored in the first middle liquid chamber 234 and the moisturizer 202 stored in the second middle liquid chamber 236 have liquid surfaces closely facing the nozzle region 126A, so that the nozzle region 126A of the nozzle surface 52 can be moisturized. Moreover, the moisturizer 202 stored in the lowermost liquid chamber 238 has a liquid surface closely facing the non-nozzle region 126B on the lower side in the perpendicular direction of the nozzle surface 52, so that the non-nozzle region 126B on the lower side in the perpendicular direction can be moisturized. Furthermore, the uppermost liquid chamber 232 and the gas space 238A of the lowermost liquid chamber 238 are linked through at least one region out of a region on the lateral surface side and a region on the back surface side of the first middle liquid chamber 234 and the second middle liquid chamber 236. Accordingly, the non-nozzle region 126B on the upper side in the perpendicular direction may also be moisturized with steam of the gas space 238A. Therefore, the caps 70, 71, 72, and 74 are preferable in view of moisturization of the head 50 (+++).

As for the number of liquid supply systems, one system is connected to the uppermost liquid chamber 322, so that the caps 70, 71, 72, and 74 are preferable as a simplified configuration is implemented (+++). As for the number of waste liquid systems, two systems are connected to the uppermost liquid chambers, so that the caps 70, 71, 72, and 74 are preferable as a simplified configuration is implemented (+++).

Furthermore, the time taken for replacing the moisturizer 202 inside the caps 70, 71, 72, and 74 is short since it is not necessary to supply the moisturizer 202 to the uppermost liquid chamber 232, which makes the caps 70, 71, 72, and 74 preferable (+++). The amount of the moisturizer 202 needed for replacement is small since it is not necessary to supply the moisturizer 202 to the uppermost liquid chamber 322, which makes the caps 70, 71, 72, and 74 preferable (+++).

Since the moisturizer 202 does not overflow from the uppermost liquid chamber 232, there is no contamination of the moisturizer 202 in the first middle liquid chamber 234 and the second middle liquid chamber 236 after replacement of the moisturizer 202, which makes the caps 70, 71, 72, and 74 preferable (+++).

Thus, the caps 70, 71, 72, and 74 according to the present embodiments can provide preferable results in view of each point including the moisturizing property, the number of liquid supply systems and waste liquid systems of the moisturizer, the time taken for and the amount needed for replacing the moisturizer, and contamination of the middle liquid chambers after replacement of the moisturizer.

<Application to Other Apparatuses and Configurations>

In the embodiments disclosed, application to an inkjet recording apparatus for color image printing has been described as an example. However, the range of application of the present invention is not limited to this example. For example, the present invention is widely applicable to liquid ejection apparatuses (including inkjet recording apparatuses and inkjet systems) which provide various shapes and patterns with liquid functional materials, such as wire drawing apparatuses which draw wiring patterns of electronic circuits, manufacturing apparatuses of various devices, resist printing apparatuses which use resin liquid as functional liquid for ejection, color filter manufacturing apparatuses, and fine structure forming apparatuses which form fine structures with materials for material deposition.

Suitable additions, modifications, and deletion of component members in the above-described embodiments of the present invention are possible without departing from the spirit of the present invention. It should be understood that there is no intention to limit the invention to the embodiments disclosed, but on the contrary, the invention is to cover all modifications made by a person with ordinary skill in the art within a technical idea of the present invention.

What is claimed is:

1. A liquid ejection apparatus, comprising:

a liquid ejection head having a nozzle surface arranged to be inclined relative to a horizontal plane, the nozzle surface having a nozzle region with a nozzle which ejects liquid formed thereon and a first non-nozzle region and a second non-nozzle region having the nozzle not formed thereon;

a liquid retainer arranged at a position facing the nozzle surface of the liquid ejection head, the liquid retainer being divided, along a direction of an inclination of the nozzle surface, into an uppermost liquid chamber arranged on an uppermost stage in a perpendicular direction so as to face the first non-nozzle region, a lowermost liquid chamber arranged on a lowermost stage in the perpendicular direction so as to face the second non-nozzle region, and a middle liquid chamber arranged between the uppermost liquid chamber and the lowermost liquid chamber so as to face the nozzle region, to store a moisturizer;

a supply device which supplies the moisturizer to a liquid supply port provided in the middle liquid chamber, the supply device passing the moisturizer which overflows from the middle liquid chamber into the lowermost liquid chamber, the lowermost liquid chamber storing the moisturizer which overflows in the direction of the inclination from the middle liquid chamber into the lowermost liquid chamber; and a discharge device which discharges the moisturizer from a waste liquid port provided in the middle liquid chamber, wherein while the moisturizer is stored in the liquid retainer, the uppermost liquid chamber and a gas space in the lowermost liquid chamber are linked through at least one region out of regions on a lateral surface side and a back surface side which are different from an open surface side of the middle liquid chamber.

2. The liquid ejection apparatus according to claim 1, wherein the liquid retainer has a plurality of middle liquid chambers divided along the direction of the inclination, the liquid supply port is provided in an uppermost middle liquid chamber positioned on an uppermost stage in the perpendicular direction among the plurality of middle liquid chambers, and the plurality of middle liquid chambers other than the uppermost middle liquid chamber are sequentially supplied with the moisturizer overflowing from the uppermost middle liquid chamber and flowing into the middle liquid chambers on a lower side in the perpendicular direction.

3. The liquid ejection apparatus according to claim 2, wherein the discharge device discharges the moisturizer from each of the waste liquid ports provided in the plurality of middle liquid chambers.

4. The liquid ejection apparatus according to claim 1, wherein the liquid retainer includes:

a first box-shaped member including a first bottom plate and a first side plate raised on a periphery of the first bottom plate; and a second box-shaped member including a second bottom plate and a second side plate raised on a periphery of the second bottom plate, the second box-shaped member being arranged in an opening of the first box-shaped member, the second box-shaped member constitutes the middle liquid chamber, with the first bottom plate and the second bottom plate being arranged at an interval, and while the moisturizer is stored, the uppermost liquid chamber on an upper side in the perpendicular direction of the second box-shaped member and the gas space in the lowermost liquid chamber on a lower side in the perpendicular direction are linked through a region between the first bottom plate and the second bottom plate.

5. The liquid ejection apparatus according to claim 4, while the moisturizer is stored, the uppermost liquid chamber and the gas space in the lowermost liquid chamber are linked through a region between the first side plate and the second side plate, the region being different from a region on a side of the uppermost liquid chamber and a region on a side of the lowermost liquid chamber.

6. The liquid ejection apparatus according to claim 1, wherein the liquid retainer includes:

a first box-shaped member including a first bottom plate and a first side plate raised on a periphery of the first bottom plate; and a surrounded region surrounded with a second side plate raised inside the first side plate, the surrounded region constitutes the middle liquid chamber, and while the moisturizer is stored, the uppermost liquid chamber on an upper side in the perpendicular direction of the surrounded region and the gas space in the lowermost liquid chamber on a lower side in the perpendicular direction are linked through a region between the first side plate and the second side plate, the region being different from a region on a side of the uppermost liquid chamber and a region on a side of the lowermost liquid chamber.

7. The liquid ejection apparatus according to claim 1, further comprising:

a first partitioning member which divides an inside of the liquid retainer into a plurality of liquid chambers along the direction of the inclination;

an air supply port provided in the lowermost liquid chamber;

an exhaust port provided in the uppermost liquid chamber; and an air supply pipe which links the air supply port and the exhaust port through at least one region out of the regions on the lateral surface side and the back surface side of the middle liquid chamber.

8. The liquid ejection apparatus according to claim 1, further comprising a waste fluid retainer which receives an inflow of the moisturizer overflowing from the lowermost liquid chamber.

9. The liquid ejection apparatus according to claim 1, further comprising a conveying drum which conveys a recording medium by retaining the recording medium on a peripheral surface, wherein the liquid ejection head has the nozzle surface being arranged to be inclined relative to the horizontal plane along the peripheral surface of the conveying drum.

10. The liquid ejection apparatus according to claim 1, wherein the liquid ejection head is a line head including a plurality of head modules arrayed in one direction.

11. A moisturizing apparatus for a liquid ejection head, comprising:

a liquid retainer arranged at a position facing a nozzle surface of a liquid ejection head arranged to be inclined relative to a horizontal plane, the nozzle surface having a nozzle region with a nozzle which ejects liquid formed thereon and a first non-nozzle region and a second non-nozzle region having the nozzle not formed thereon, the liquid retainer being divided, along a direction of an inclination of the nozzle surface, into an uppermost liquid chamber arranged on an uppermost stage in a perpendicular direction so as to face the first non-nozzle region, a lowermost liquid chamber arranged on a lowermost stage in the perpendicular direction so as to face the second non-nozzle region, and a middle liquid chamber arranged between the uppermost liquid chamber and the lowermost liquid chamber, to store a moisturizer;

a supply device which supplies the moisturizer to a liquid supply port provided in the middle liquid chamber, the supply device passing the moisturizer, which overflows in the direction of the inclination from the middle liquid chamber, into the lowermost liquid chamber where the moisturizer is stored; and a discharge device which discharges the moisturizer from a waste liquid port provided in the middle liquid chamber, wherein while the moisturizer is stored in the liquid retainer, the uppermost liquid chamber and a gas space in the lowermost liquid chamber are linked through at least one region out of regions on a lateral surface side and a back surface side which are different from an open surface side of the middle liquid chamber.

* * * * *